US005881661A

United States Patent [19]

Lawendowski et al.

[11] Patent Number: 5,881,661

[45] Date of Patent: Mar. 16, 1999

[54] LEG BINDING ATTACHMENT SYSTEM

[75] Inventors: John Thomas Lawendowski, Utica, N.Y.; Tadeusz A. Olewicz, Hoschton, Ga.

[73] Assignee: Jet Sew Technologies, Inc., Bowling Green, Ky.

[21] Appl. No.: 974,309

[22] Filed: Nov. 19, 1997

[51] Int. Cl.[6] ..... D05B 35/06; D05B 35/10

[52] U.S. Cl. ..... 112/470.03; 112/152; 112/153; 112/322

[58] Field of Search ..... 112/470.14, 152, 112/153, 475.12, 475.03, 475.04, 306, 470.33, 470.15, 470.07, 322, 147, 470.03, 318

[56] References Cited

U.S. PATENT DOCUMENTS

| | | | |
|---|---|---|---|
| 4,019,447 | 4/1977 | Blessing et al. . | |
| 4,714,036 | 12/1987 | Raisin et al. . | |
| 4,748,922 | 6/1988 | Bierbaum et al. | 112/470.33 X |
| 4,896,618 | 1/1990 | Blake et al. | 112/147 X |
| 5,119,746 | 6/1992 | Nishikawa et al. | 112/153 X |
| 5,222,450 | 6/1993 | Ackermann . | |
| 5,370,071 | 12/1994 | Ackermann . | |
| 5,370,072 | 12/1994 | Adamski, Jr. | 112/306 X |
| 5,437,238 | 8/1995 | Price et al. | 112/153 X |
| 5,448,960 | 9/1995 | Navlyt et al. | 112/152 X |
| 5,454,335 | 10/1995 | Burt et al. . | |
| 5,456,193 | 10/1995 | Boot . | |
| 5,458,074 | 10/1995 | Kojima et al. | 112/470.03 |
| 5,503,095 | 4/1996 | Burt et al. . | |
| 5,579,708 | 12/1996 | Kambara et al. | 112/320 X |

OTHER PUBLICATIONS

Brochure: Rimoldi S.r.l.—*Rimoldi: the future behind us, as always,* 7 pgs.

Brochure: Profeel s.r.l.—ZYPPY—*Automatic seaming system for any standard machine,* 4 pgs .

*Primary Examiner*—Ismael Izaguirre

[57] ABSTRACT

A semi-automatic leg binding attachment system includes a pair of infeed guide plates leading towards and terminating in a pair of sew heads. To align the garment as it is fed into the sew heads, a combination of pneumatic garment aligners and active, mechanical garment aligners are provided. The pneumatic garment aligners preferably include fine and coarse pneumatic garment aligners attached to the infeed guide plates. A central material blower blows downwards towards the garment to eliminate folds and maintain garment tension against which the active, mechanical aligners pull. Easy operator access during garment loading is provided by devices which disengage the fine pneumatic aligners and the active, mechanical aligners away from the infeed guide plates. To load the garment, the operator lays the garment onto the infeed guide plates and places a leading edge of the garment below material present/foot drop sensors. During the sew cycle, a controller receives signals from alignment detectors and material edge aberration detectors to control the operation of the active, mechanical garment aligners and maintain correct garment alignment. An end-of-garment detector stops the sew cycle.

50 Claims, 20 Drawing Sheets

S5
START
S10
IS MATERIAL PRESENT EYE 404 BLOCKED ?
N
Y
S15
TURN ON FOLDER BLOWERS 344,346
S20
IS SEW MOTOR CYLINDER 367 ACTUATED ?
N
Y
S25
DROP SEWING FEET 322 AND SEW A FEW STITCHES
Y
S30
ARE SEW FEET 322 DOWN ?
N
Y
S35
IS EITHER START EYE 238,248 BLOCKED ?
N
Y
S40
CLOSE ROTARY ACTUATORS 221
TURN ON AIR TO ALIGNERS 226,236
ACTUATE ALIGNER LIFT CYLS. 266
BEGIN MECHANICAL ALIGNMENT
Y
S45
ARE BOTH START EYES 238,248 BLOCKED ?
N
Y
S50
START SEW CYCLE
A

Prior Art 202
204
112
203
204'
A 112
266'
266
267
A
260
268
255
260'
B

LEG BINDING ATTACHMENT SYSTEM

BACKGROUND OF THE INVENTION

1. Field of the Invention

This invention generally relates to a system for sewing leg bindings on a garment. More particularly, this invention relates to a garment guiding and aligning apparatus for guiding and aligning a garment, such as a pair of men's briefs, into a dual leg binding attachment apparatus so that both leg bindings may be simultaneously and accurately sewed onto the garment.

2. Description of the Prior Art

The age of automation has revolutionized just about every manufacturing process and operation throughout all industries. The ever-accelerating race for less expensive, better quality, and quickly produced consumer goods is resulting in quantum leaps in the development of automatic and semi-automatic machinery. In the case of apparel and textile industries, especially including manufacturers of undergarment clothing and knit garments, automation has been slow to develop. The delay is mostly due to the availability of high production sew heads that can be operated by low cost manual labor in developing countries. To this day, manufacturing men's briefs utilizes manual labor in just about all steps of production.

For example, to sew the leg binding on a pair of men's briefs, an operator manually loads each so-called "tube fly" (which is the center front part of the garment) into a sew head and then manually sews the binding on either side of the tube fly. This process, even in the case of the most skilled operators, is quite slow. The garments are then stacked and moved to the next operation, which is generally the "flat lock" operation where the garment's crotch area is sewn together.

To speed up this manual leg bind operation, it is also known to use two sew heads in combination to sew both leg bindings on the garment in one manual operation. For example, Rimoldi sells the Gemini class leg binding machine, the right half of which is illustrated in FIG. 11. As shown in FIG. 11, each half of the Gemini class machine includes a sew head 112 which is equipped with known elements such as a leg binding payout device (not shown); a leg binding tension control device 158; a leg binding folder device 342; and a leg binding cut-off device 352. With this conventional machine, the operator manually guides and aligns the brief as the two sew heads sew the respective leg bindings on the garment.

It is quite difficult, however, for the operator to accurately align the garment as both leg bindings are being sewed onto the garment. Therefore, the quality of the finished garment may be compromised with this manually operated machine. Furthermore, this manual process is unacceptably slow and does not yield the high output that today's competitive clothing industry demands. One factor contributing to low output is that the operator must maintain garment alignment throughout the leg binding operation and cannot pick up the next garment until this operation is completed.

Previously, there have been attempts at automating the leg binding operation. For example, Burt '095 (U.S. Pat. No. 5,503,095) discloses an edge binding applying apparatus which utilizes a slidable binding fixture 600 to hold the garment as it is conveyed through a pair of sew heads 202. In Burt '095, the garment must be clamped to the binding fixture 600 using two clamping assemblies 630 and 633. After clamping the men's briefs into the binding fixture, the entire holding fixture 600 is linearly conveyed along track 604 so that the two sew heads 202 can apply bindings to the edges of the leg openings of the brief.

As can be seen from the various drawing figures, Burt's edge binding applying apparatus is quite complicated and includes an articulated holding fixture 600 having a multitude of moving parts, joints and sub-assemblies. Furthermore, Burt's apparatus requires a rather cumbersome clamping procedure in which the pair of men's briefs must be accurately placed and then clamped into the holding fixture 600. Therefore, Burt '095 suffers from an unduly complicated apparatus requiring accurate and cumbersome clamping and alignment of the briefs in the holding fixture 600 before the holding fixture may be linearly conveyed through the pair of sew heads 202. The complexity of Burt's machine inevitably leads to a high rate of mechanical failure which results in costly production downtime. Furthermore, the linkages and moving parts in Burt's machine are susceptible to contamination from lint and dust which further contributes to equipment breakdown, garment misalignment and costly downtime.

As described above, there is a need for an apparatus and method that simultaneously applies both leg bindings on a garment which avoids complicated mechanisms such as Burt '095. More particularly, there is a need for a high output, semi-automated leg binding machine that is not susceptible to contamination or breakdown and which consistently produces a high quality garment.

SUMMARY OF THE INVENTION

It is, therefore, an object of the present invention to semi-automate the leg binding operation. Another object of the invention is to provide a leg binding system which automatically aligns the garment as it is fed through two sew heads that apply leg bindings to the garment.

It is another object of the invention to provide a garment guiding and aligning apparatus for guiding and aligning a garment as it is fed into a dual leg binding attachment apparatus that includes a pair of sew heads which simultaneously sew left and right leg bindings on the garment.

The objects of the present invention are achieved by providing a pair of infeed guide plates which provide a surface for guiding the garment into a pair of sew heads.

The objects of the invention are further achieved by mounting a plurality of pneumatic alignment assemblies along the infeed guide plates which align the garment as it is fed into the sew heads. The objects of the invention are still further achieved by providing an active, mechanical garment aligner which actively aligns the garment just before the leg bindings are sewn onto the garment. Still further, alignment detectors detect the alignment of the garment relative to the infeed guide plates to permit accurate control of the active, mechanical garment aligner.

The objects of the invention are still further achieved by providing a central material blower that blows downwards toward a central space provided between the infeed guide plates to eliminate any wrinkles or folds in the garment and to provide a force against which the active, mechanical garment aligner pulls to align and flatten the garment as it is being fed into the sew heads.

Even further, a sewing cycle trigger is used to initiate the sewing cycle whereupon the sew heads feed in the garment and sew on the leg bindings while the garment is aligned by the pneumatic aligners and active, mechanical garment aligner.

More particularly, the operation of the invention is a semi-automatic process in which an operator manually places the unfinished briefs (tube fly) onto the infeed guide plates, engages the garment with pneumatic aligners, and triggers a sensor which drops both sewing machine presser feet to hold the leading edge of the garment in place. Triggering the sewing cycle causes the pneumatic aligners to align the garment, the active, mechanical garment aligner to further align the garment and the sew heads to begin sewing the leg bindings onto the garment. Furthermore, alignment detectors control the active, mechanical garment aligner to provide the final alignment of the garment before the leg binding is sewn thereupon.

The objects of the invention are preferably achieved by providing two pair of pneumatic aligners including a coarse pneumatic aligner and a fine pneumatic aligner. Final alignment is achieved with a pair of active, mechanical garment aligners which mechanically move the garment in a lateral direction according to the input from the alignment detectors.

The objects of the invention are even further achieved by including a fine pneumatic alignment disengagement device which disengages the fine pneumatic aligners from the infeed plates during the garment loading process so that the operator may more easily access the system to load the garment.

The objects of the invention are still further achieved by including a mechanical garment aligner disengagement device which disengages the active, mechanical garment aligner away from the infeed guide plates during the garment loading process to permit the operator to more easily access the system and which engages the active, mechanical garment aligner during only the sewing cycle to provide the final alignment of the garment.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus are not limitative of the present invention, and wherein:

FIG. 6(*b*) is a detailed view of the fine pneumatic aligner and actuator;

FIG. 6(*c*) is a front view of the invention showing the relationship of the right foot drop eye and material present/folder blower on-off eye with respect to the right infeed guide plate;

FIG. 7(*c*) shows the garment in relation to the invention during the sewing cycle;

DETAILED DESCRIPTION OF THE PREFERRED EMBODIMENT

Figure 1:
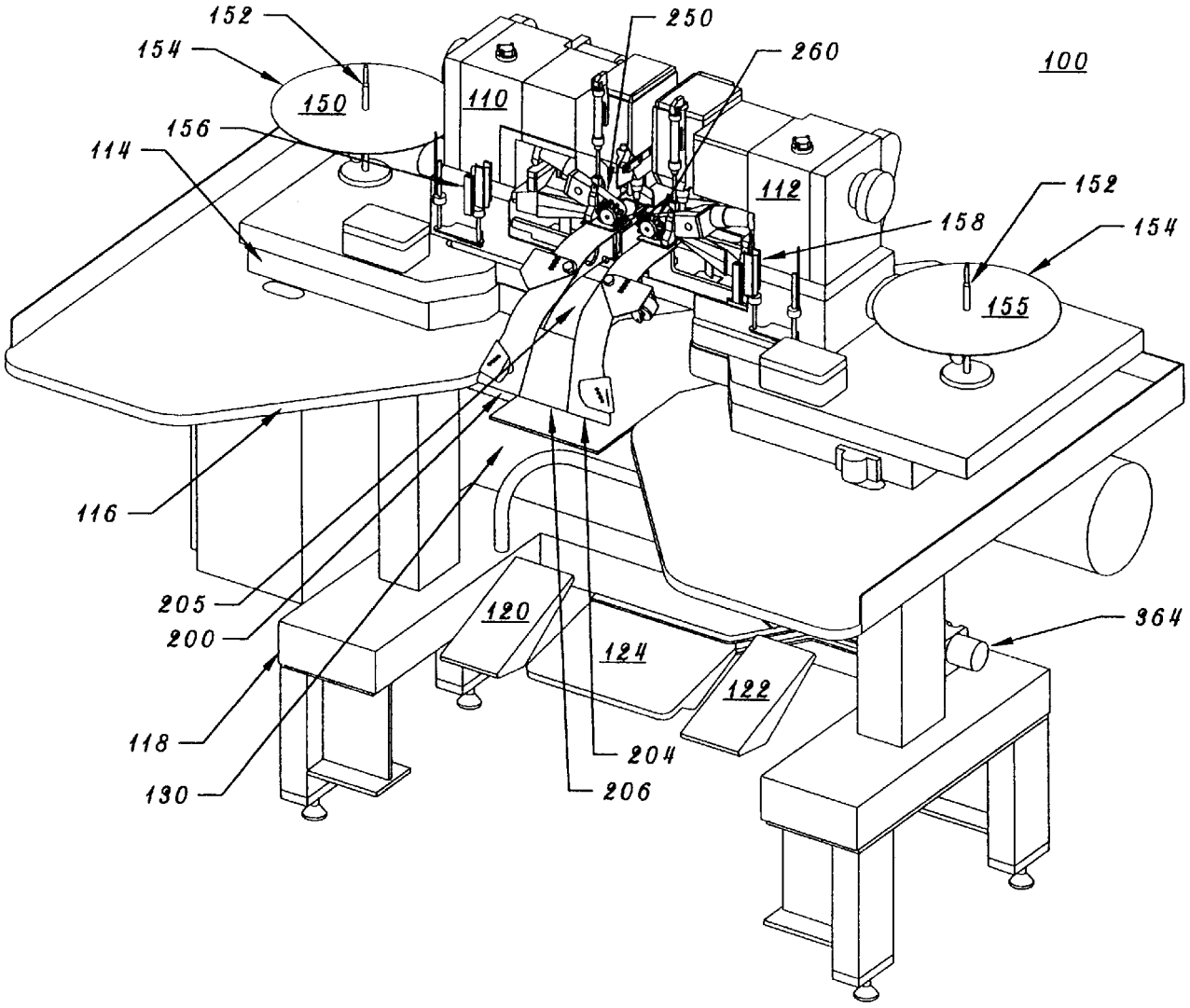
FIG. 1 is an isometric view showing the major components of the leg binding system according to the present invention.

In the drawings and detailed description, like reference numerals are utilized to illustrate like components. Furthermore, the invention has left-right symmetry. For brevity, the detailed description will sometimes refer to only to the right-half of the system with the understanding that the description equally applies to the left-half of the system.

FIG. 1 is an isometric view of the semi-automatic dual leg binding system 100 of the invention which shows the major components thereof. The components of the system 100 are supported by a platform 114 which is mounted to a base 118 and which includes a recessed portion 116 that permits easy operator access to the system 100. A left sew head 110 and right sew head 112 are mounted to a platform 114 such that the left sew head 110 faces towards the right sew head 112.

Manual control of the sew heads 110, 112 is provided by left and right sew head foot pedals 120, 122 which are mounted to the base 118. Also mounted to the base 118 is combined sew head foot pedal 124 which simultaneously controls the left and right sew heads 110, 112. A main switch is also included (not shown) to turn the entire system 100 on or off.

Figure 12:
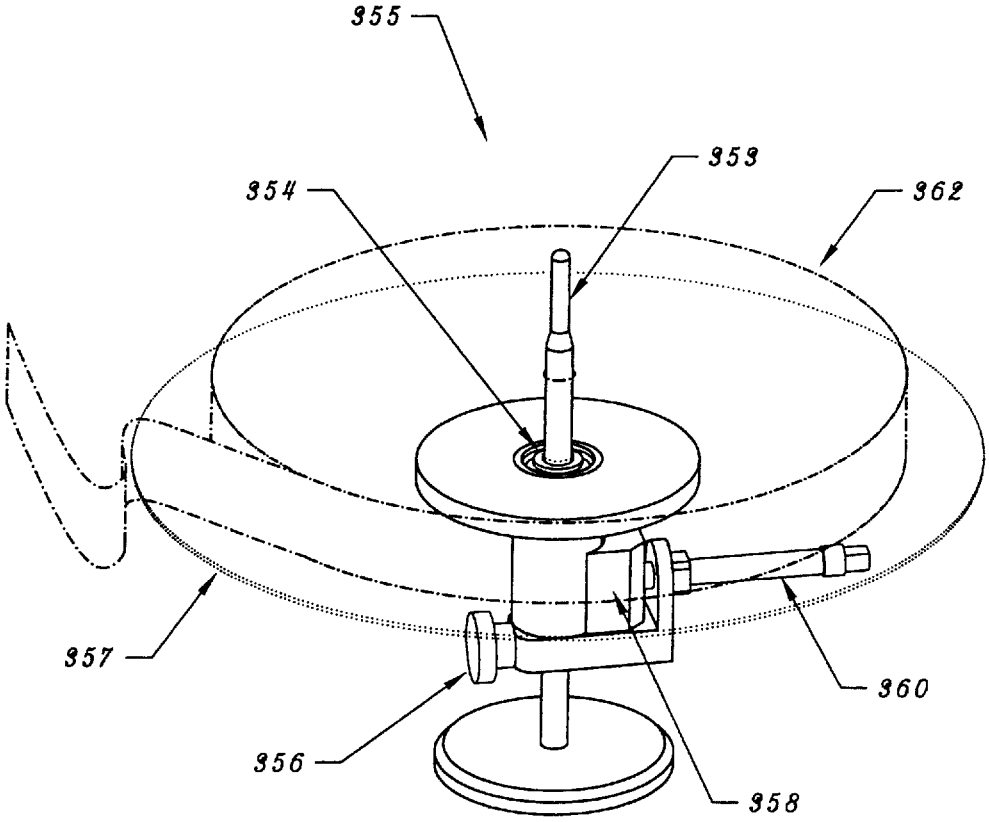
FIG. 12 is a detailed view of a leg binding payout spool assembly according to the present invention.

As known in the art, leg binding pay-out assemblies 150, 155 are provided for the sew heads 110, 112. Each of the leg binding pay-out assemblies 150, 155 includes a leg binding feed spindle 152 and leg binding spool support 154 which collectively receive a leg binding spool 362. The leg binding spools 362, which include a supply of leg binding, are mounted on the leg binding feed spindle 152 and are supported by the leg binding spool supports 154. An optional leg binding pay-out assembly 355 according to the present invention is shown in FIG. 12.

As further shown in FIG. 1, left and right leg binding tension control assemblies 156, 158 are mounted to the left and right sew heads 110, 112. The leg binding tension control assemblies 156, 158 maintain a constant leg binding tension between the leg binding tension control assemblies 156, 158 and the sew heads 110, 112.

Each half of a garment guiding assembly 130 is attached individually to sew heads 110,112 near the recessed portion 116. The garment guiding assembly 130 includes left and right infeed guide plates 200, 204 that span between the platform 114 and the sew heads 110, 112. The left and right infeed guide plates 200, 204 are joined by a spanning member 206 and have a central space 205 therebetween.

The garment guiding assembly 130 further includes two active, mechanical garment aligners 140 which are provided immediately downstream from the sew heads 110, 112. Further details of the garment guiding assembly 130 will be described in relation to FIGS. 2–4 below.

Figure 2:
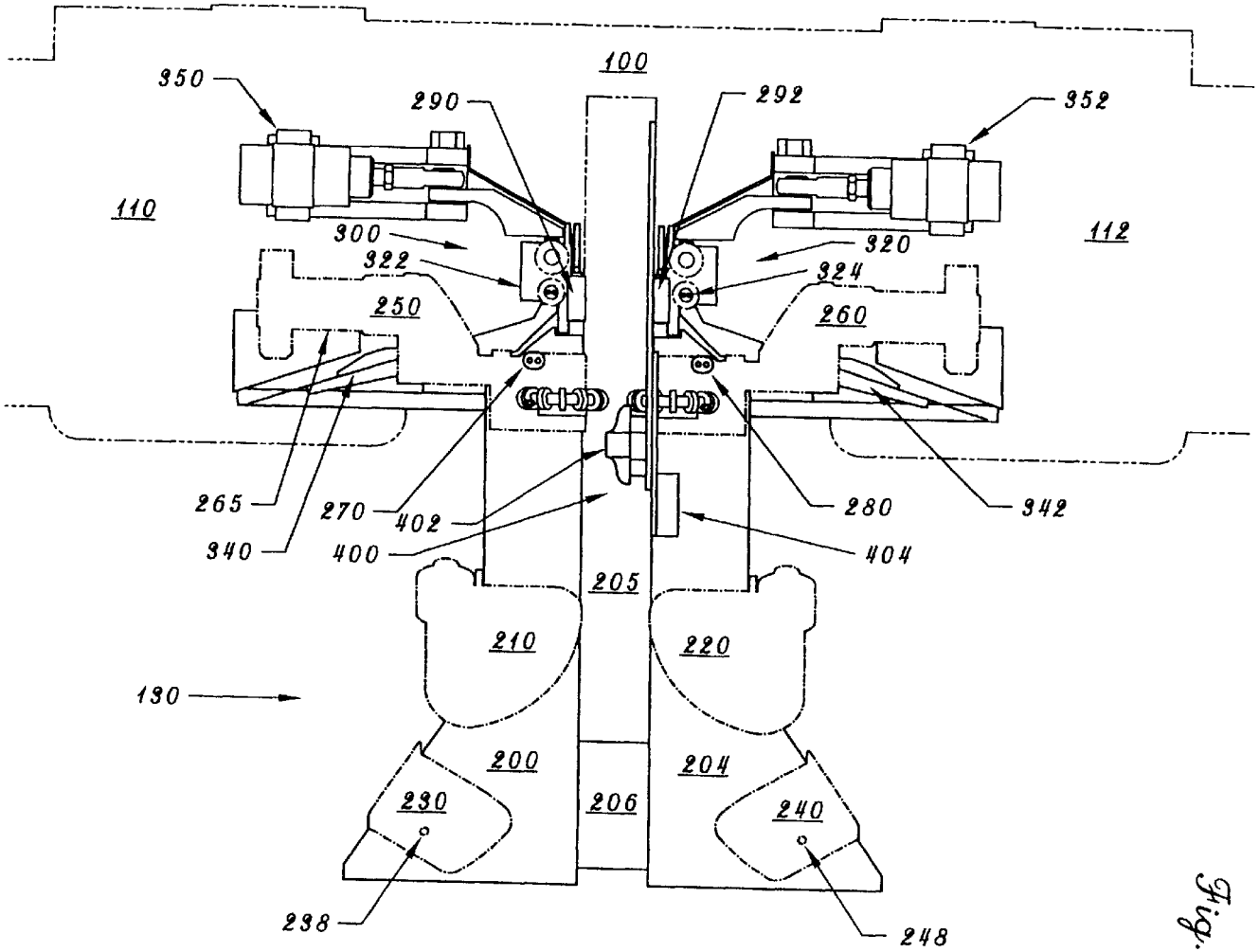
FIG. 2 is an overhead plan view showing components of the garment guiding apparatus according to the present invention.

FIG. 2 is a plan view of the garment guiding assembly 130 which is a part of the leg binding system 100. FIG. 2 diagrammatically shows the relationship between the garment guiding assembly 130 and the sewing assemblies 300, 320. The sewing assemblies 300, 320 are a part of the sew heads 110, 112. For the purposes of this disclosure, it is sufficient to state that each of the sewing assemblies 300, 320 includes a sewing foot 322 which holds the garment in place as it is sewn by sewing needles 324 and progressively moved by feed dogs (not shown).

As more clearly shown in FIG. 2, spanning member 206 connects the left and right infeed guide plates 200, 204 at their lower (downstream) ends. The spanning member 206 also supports the trailing end of the garment while being sewn. The central space 205 is provided upstream from the spanning member 206 and between the left and right infeed guide plates 200, 204. Furthermore, the infeed guide plates 200, 204 are preferably constructed with a durable material such as stainless steel or plastic which is capable of being formed to have a smooth garment engaging surface.

Several types of devices are provided to align the garment as it is pulled into the sew heads 110, 112 by the feed dogs: pneumatic garment alignment devices 210, 220, 230, 240 use compressed air to force the garment against alignment pins; and mechanical garment alignment devices 250, 260 use a controlled motor to actively align the garment. Due to the high rate of speed in which the feed dogs pull the garment through the sew heads 110, 112, a precise and active garment alignment is required. The combination of pneumatic and controlled mechanical garment alignment achieves this demanding task.

One example of a commercially available pneumatic garment alignment device is the Zyppy Aligner made by Profeel.

The working embodiment of the invention generally described in the drawings adapts the conventional Zyppy Aligner to the infeed guide plates 200, 204. More particularly, the upper pneumatic aligners 210, 220 have a unique swinging action wherein a motor 600 (See FIG. 6(*b*)) swings the upper pneumatic aligners 210, 220 away from the infeed guide plate 200, 204 to permit easy loading of the garment into the system 100 and also to permit maintenance of the various component of the system 100.

A working example of the invention which is generally depicted in the drawings and diagrammatically shown in FIG. 2 includes upper pneumatic aligners 210, 220 which are respectively mounted to the infeed guide plates 200, 204. Each of the upper pneumatic aligners 210, 220 includes an upper alignment plate 222 (See FIG. 6(*b*)) spaced apart from and substantially parallel to the infeed guide plates 200, 204.

Figure 3:
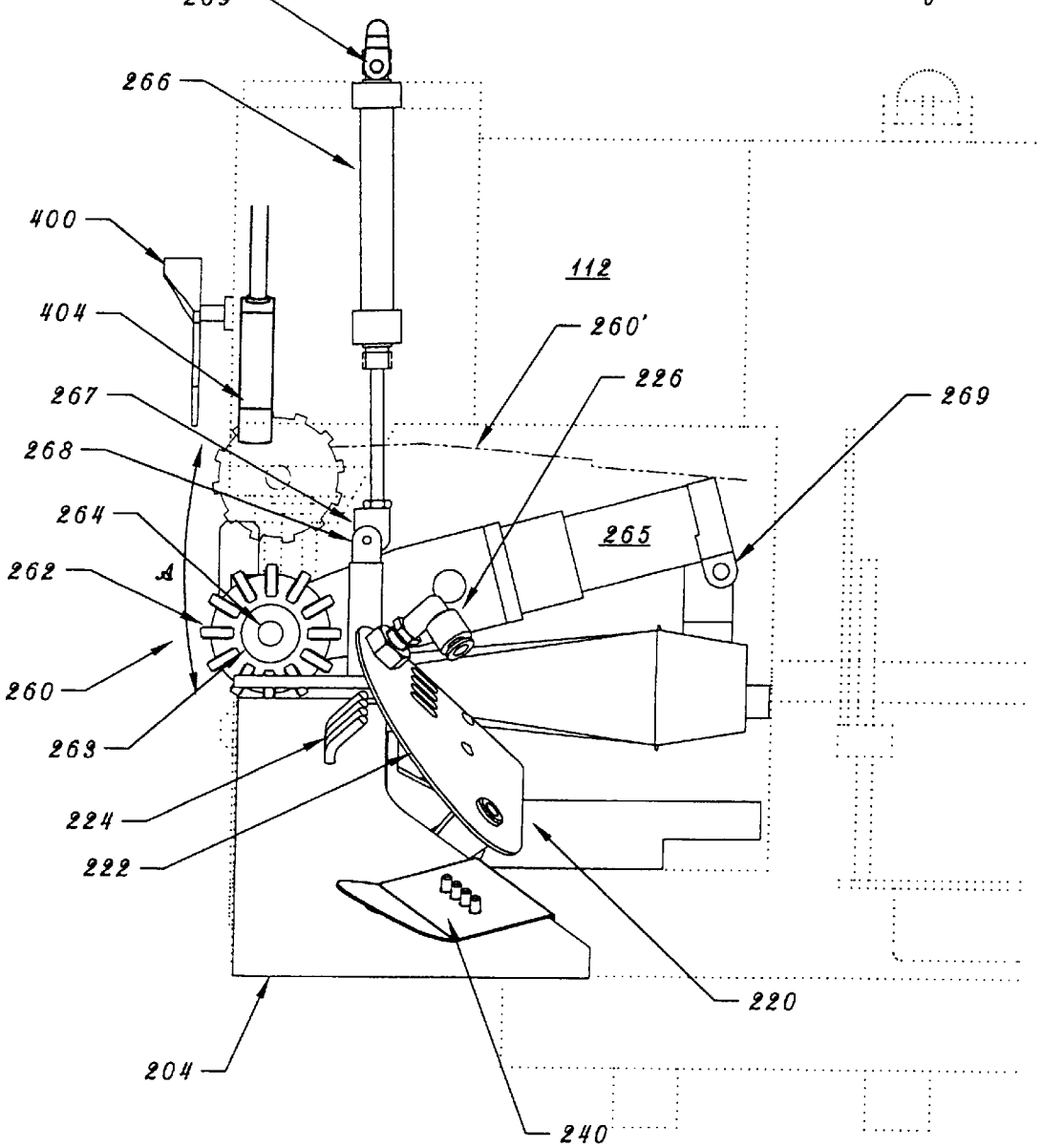
FIG. 3 is a front view of the right-half of the leg binding system according to the present invention.

Furthermore, FIG. 3 shows upper alignment pins 224 are mounted to the infeed guide plates 200, 204 and bridge the gaps between the alignment plates 222 and the infeed guide plates 200, 204, respectively.

A blower 226 (See FIG. 4) is mounted to an inboard side of each upper pneumatic aligner 210, 220 and faces towards the upper alignment pins 224. An air supply (not shown) supplies compressed air to the blower 226 as will be described in detail below.

As further shown in FIG. 2, lower pneumatic aligners 230, 240 are respectively mounted to a lower portion of the infeed guide plates 200, 204 with respect to the upper pneumatic aligners 210, 220. Each of the lower pneumatic aligners 230, 240 includes a lower alignment plate 232 (See FIG. 7(*c*)) spaced apart from and parallel to the infeed guide plates 200, 204.

Figure 7A:
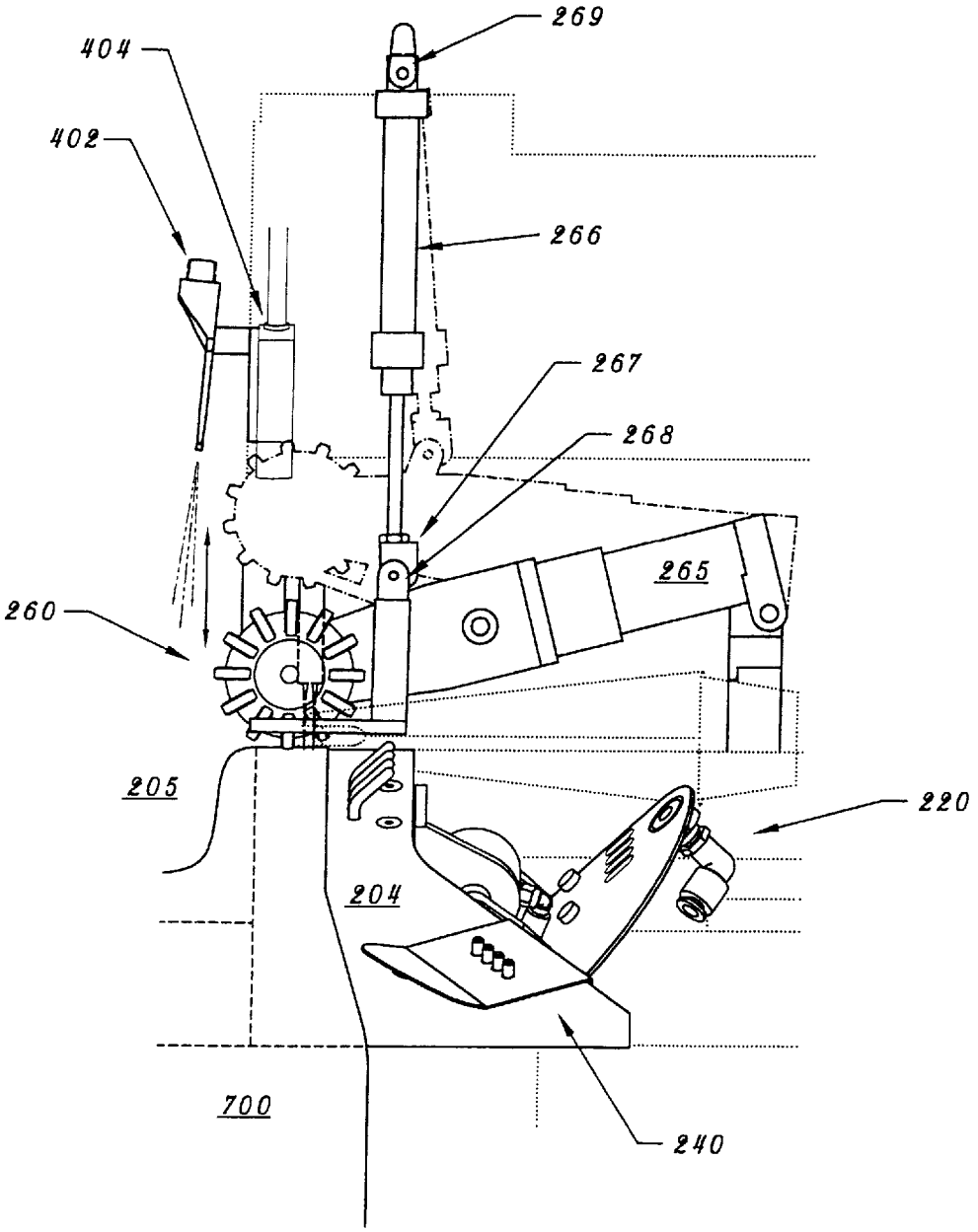
FIGS. 7(*a*) and 7(*b*) are drawings which show the garment in relation to the invention during the garment loading process.
Figure 7B:
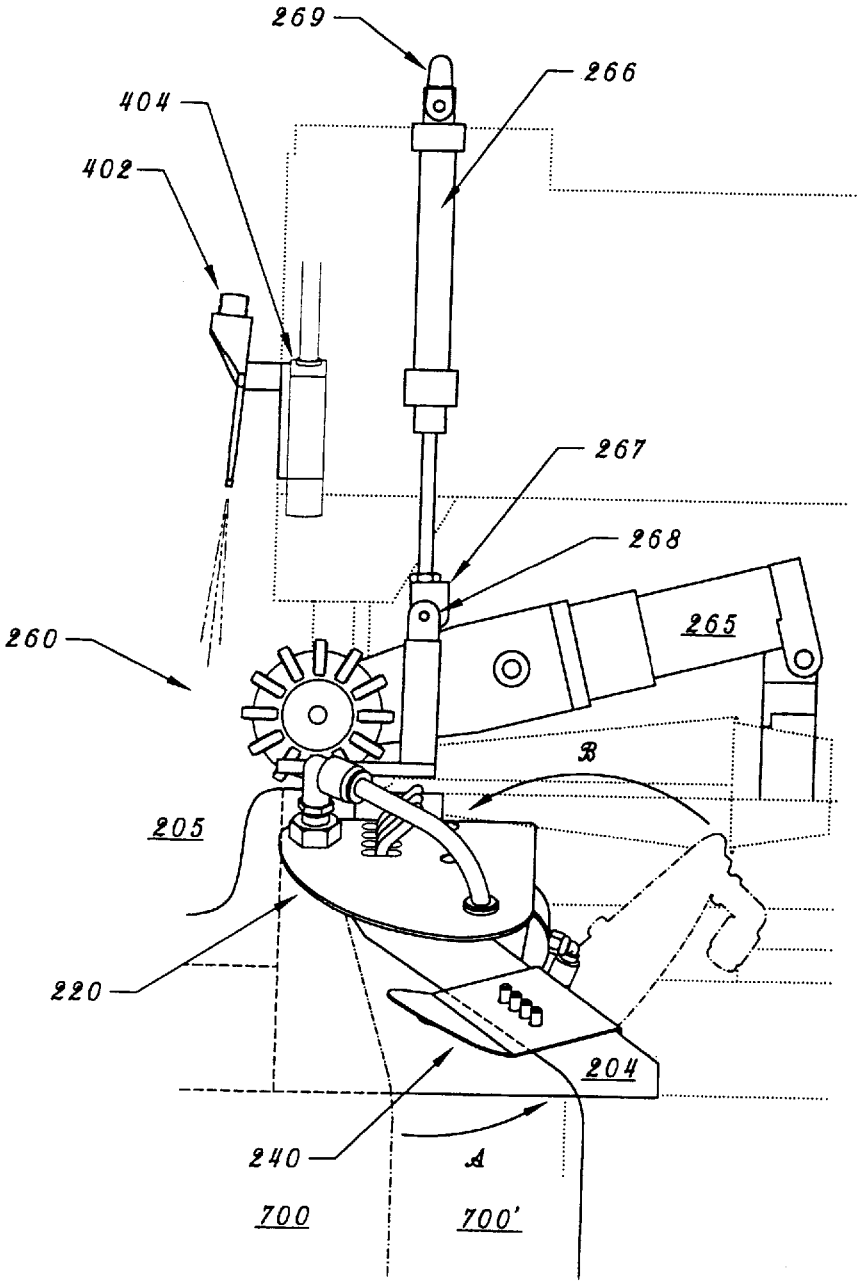
Figure 7C:
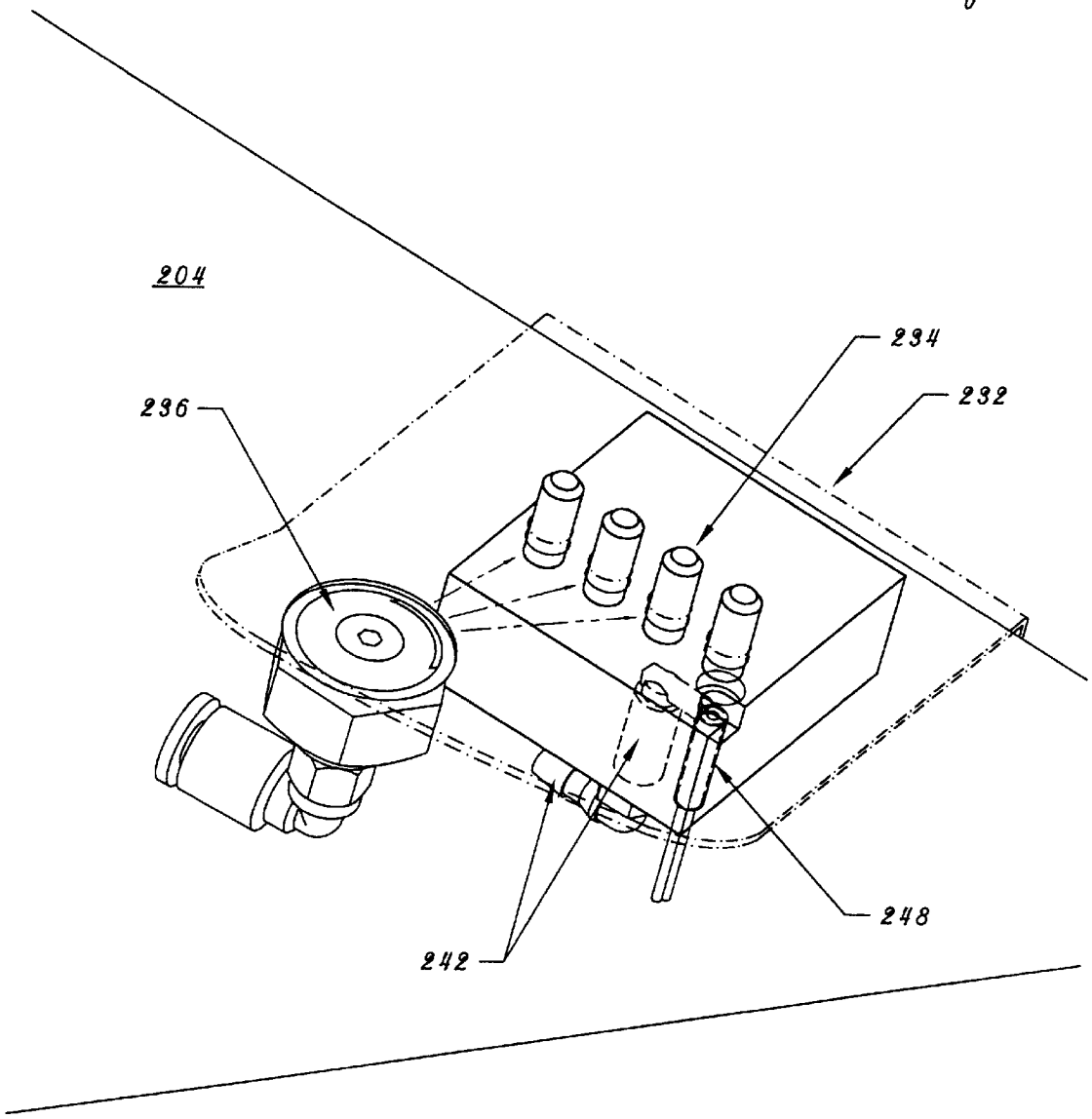

Also, lower alignment pins 234 (See FIG. 7(*c*)) are mounted to the infeed guide plates 200, 204 and bridge the gap between the alignment plate 232 and the infeed guide plates 200, 204.

A blower 236 (See FIG. 7(*c*)) is mounted in each of the lower pneumatic aligners 210, 220 in a manner similar to blower 226.

As will be further described in the operation section below, the upper pneumatic aligners 210, 220 fine tune the alignment of the garment relative to the infeed guide plates 200, 204; hence, they are also referred to as fine pneumatic aligners 210, 220. Similarly, the lower pneumatic aligners 230, 240 are referred to as coarse pneumatic aligners 230, 240.

Sew cycle start sensors 238, 248 are provided so that the operator can initiate the sewing cycle. More particularly, the sew cycle start sensors 238, 248 detect the presence of the garment within the lower pneumatic aligners 230, 240. The preferred embodiment locates these sensors 238, 248 at a leading portion of the lower alignment plates 232 as shown in FIG. 2. The sew cycle start sensors 238, 248 are preferably photo-electric eyes which are individually triggered when the garment is placed between each of the sew cycle start sensors 238, 248 and the infeed guide plates 200, 204, respectively.

The garment guiding assembly 130 further includes active, mechanical garment alignment devices 250, 260 which cooperate with the coarse and fine pneumatic aligners 230, 240, 210, 220. As described in the illustrative example below, the active, mechanical garment aligners 250, 260 of the invention utilize a controlled motor 265 to actively align the garment in response to garment alignment sensors 270, 280.

An example of an active, mechanical garment aligner which may be used with the invention is disclosed by Raisin et al. in U.S. Pat. No. 4,714,036 which issued on Dec. 22, 1987, the contents of which are hereby incorporated by reference.

The active, mechanical garment aligners 250, 260 are provided upstream with respect to the fine pneumatic alignment assemblies 210, 220 but before the sewing assemblies 300, 320. The operation of the active, mechanical garment aligners 250, 260 and adaptation of these active, mechanical garment aligners 250, 260 to the invention will be more particularly described in relation to FIG. 3 below.

Alignment detectors 270, 280 are mounted in the infeed guide plates 200, 204 near the outer edge of the garment feed path and immediately downstream with respect to the active, mechanical garment aligners 250, 260.

Figure 5:
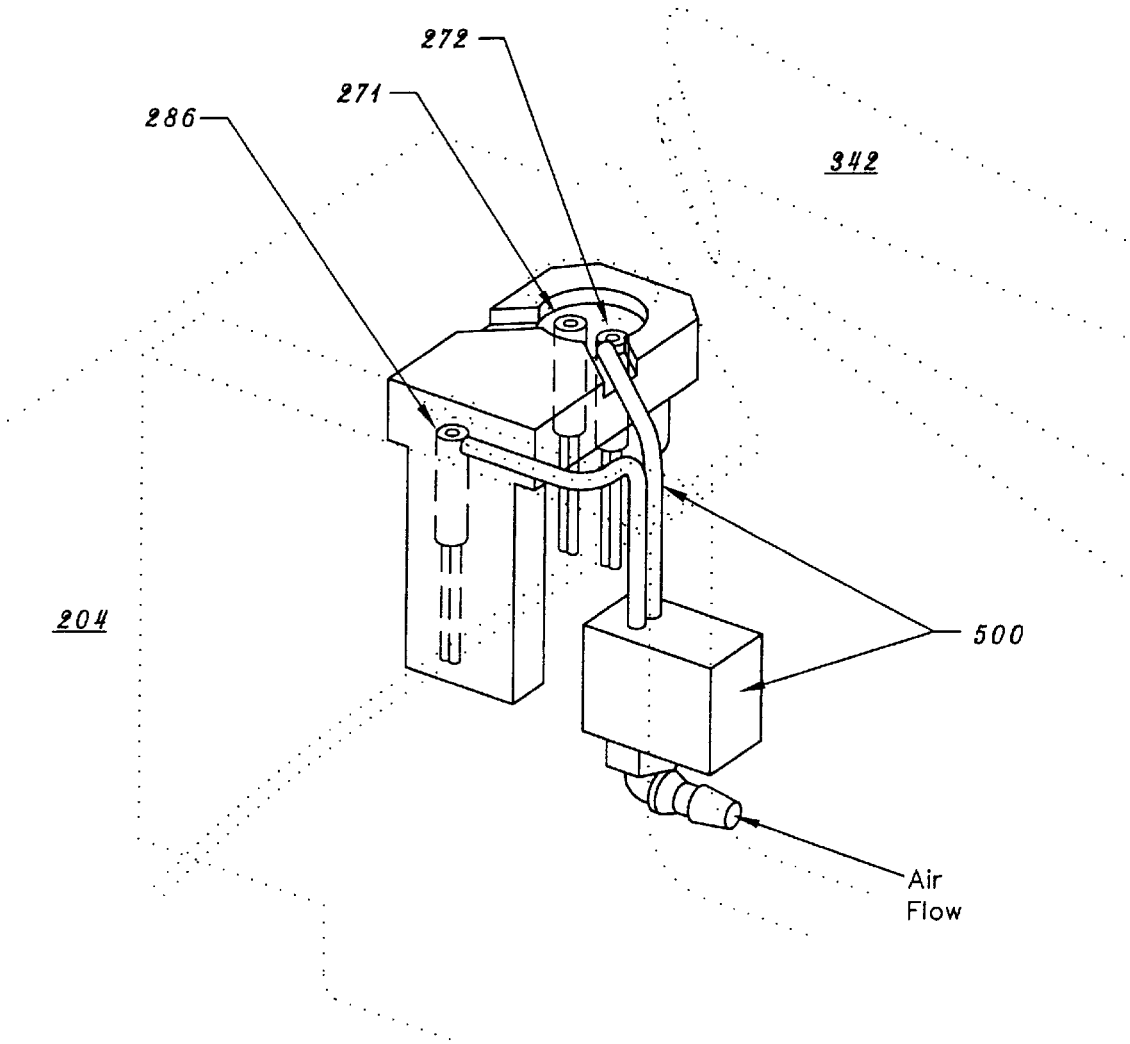
FIG. 5 is a drawing showing the details of the aligner eye lint blower manifold and jet tubes.

Each of the alignment detectors 270, 280 includes an inner alignment detector 271 and an outer alignment detector 272 (See FIG. 5). As will be described in more detail below, garment alignment is achieved by maintaining the garment between the inner alignment detector 271 and the outer alignment detector 272.

A material blower/detector assembly 400 is mounted to one of the sew heads 110, 112 directly above the central space 205 and between the infeed guide plates 200, 204. The material blower/detector assembly 400 includes a central material blower 402 which blows air towards the central space 205. A central material detector 404 is mounted on the central material blower 402 and faces towards the central space 205. The material detector 404 detects the presence of a garment below the material detector 404.

Material present/foot drop sensors 290, 292 are mounted to sew heads 110, 112 upstream from the infeed guide plates 200, 204 and along side of the feet to detect the presence of the garment directly below the sewing needles 324 of both sew heads 110,112. When triggered, the material present/foot drop sensors 290, 292 instruct the sew heads 110, 112 to engage the garment by dropping the sewing feet 322.

For example, the right material present/foot drop sensor detector 292 senses when the garment has been successfully placed underneath the right sewing needle 324 to thereby trigger the right sewing foot 322 to drop and engage the right side of the garment. A similar operation is individually or cooperatively performed by the left material present/foot drop sensor 290. Further details concerning the operation of the sensors in relation to the invention are described below in relation to FIGS. 9(*a*) and 9(*b*).

Figure 11:
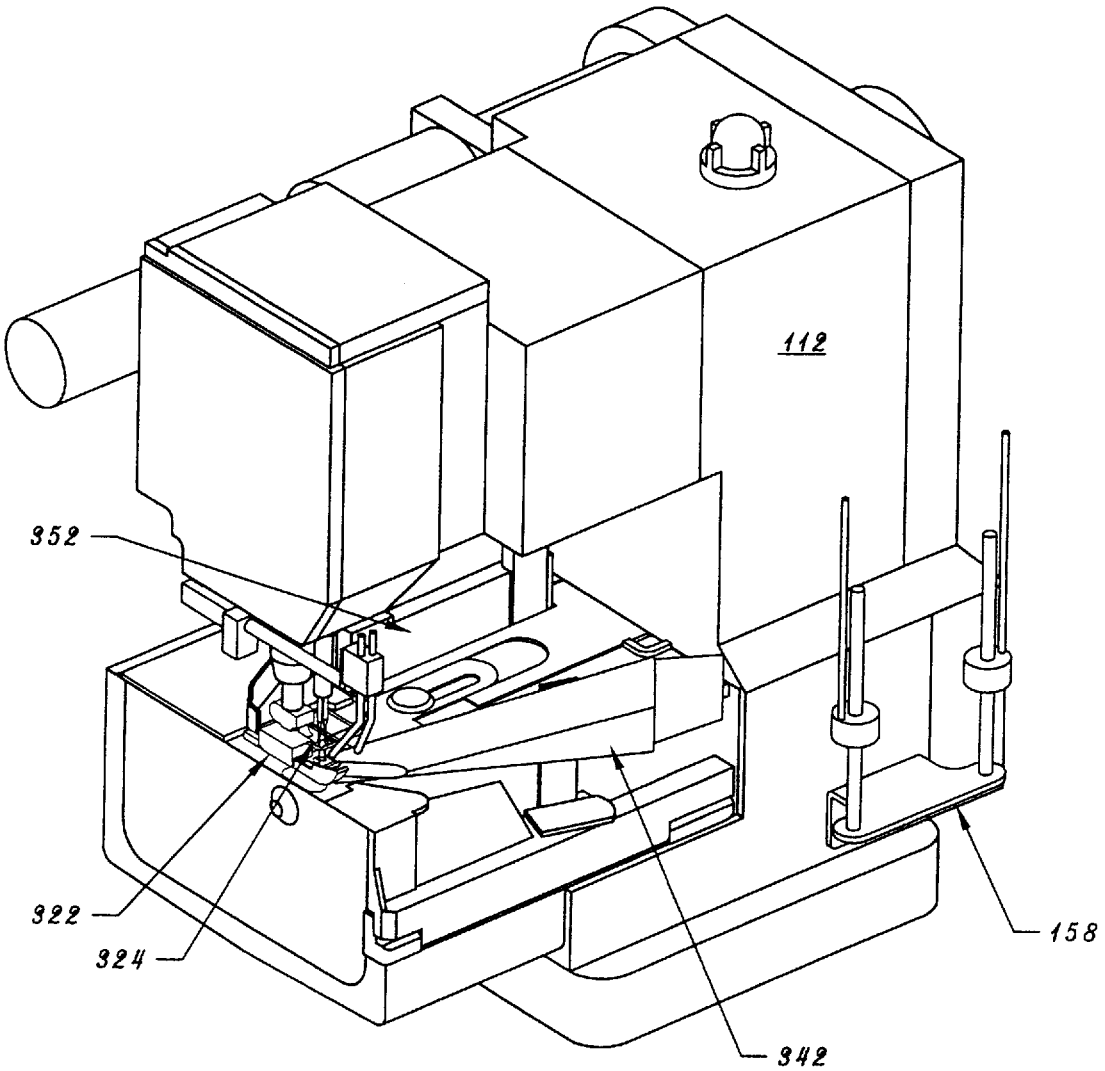
FIG. 11 is a drawing showing a conventional, manually operated leg binding sewing apparatus.

As known in the art and as shown in FIGS. 2 and 11, the sew heads 110, 112 are further provided with left and right leg binding folders 340, 342. The leg binding folders 340, 342 fold the leg bindings into a C-shape before they are sewn onto the garment by the sewing assemblies 300, 320. Leg binding cut-off devices 350, 352 are also provided, as known in the art, upstream from and mounted to the sew heads 110, 112 to cut-off the leg bindings at the completion of the sewing cycle.

FIG. 3 is a front view which more clearly shows the structural arrangement of the active, mechanical garment aligner 260. As shown in FIG. 3, the active, mechanical garment aligner 260 includes a plurality of secondary wheels 262 that are circumferentially disposed around a central wheel 263. The central wheel 263 rotates around a central wheel axle 264. Furthermore, the secondary wheels 262 also rotate around respective axes that are substantially tangential to the central wheel 263.

As will be described in more detail below, the central wheel 263 is forcibly rotated by a motor 265 around central wheel axle 264 to align the garment in a lateral direction. Because the secondary wheels 262 freely rotate, the garment easily passes beneath the active, mechanical garment aligner 260 as it is fed into the sew head 112.

As further shown in FIG. 3, the mechanical garment aligner 260 is disposed at one end of an aligner lift arm 268. An aligner lift arm pivot 269 connects the other end of the aligner lift arm 268 to the sew head 112. An aligner lift device 266, which raises and lowers the aligner lift arm 268 via aligner lift connecting rod 267, is connected to an upper portion of the sew head 112. The connection of the aligner lift connecting rod 267 to the aligner lift arm 268 is a pivotal connection as shown in FIG. 3.

The engaged (lowered) position of the mechanical garment aligner 260 and aligner lift arm 268 are shown using solid lines in FIG. 3. The arrow A indicates the up and down movement of the mechanical garment aligner 260 between the disengaged position and the engaged position. The disengaged (raised) 260' position of the mechanical garment aligner 260, is shown using phantom lines in FIG. 3.

The aligner lift arm 268 is raised and lowered between the disengaged and the engaged position by the aligner lift device 266. Preferably, this aligner lift device 266 is a pneumatically operated cylinder.

The disengaged position 260' for the active, mechanical garment aligner 260, permits the operator to easily load the garment into the system 100. In the engaged position, the active, mechanical garment aligner 260 can laterally align the garment as it is fed into the sew head 112 during the sew cycle.

An alignment motor 265 is disposed within the aligner lift arm 268 as shown in FIG. 3. Alignment motor 265 forcibly rotates the central wheel 263 around central wheel axle 264 to thereby align the garment in a lateral direction. Details of this alignment motor 265 and its structural arrangement with respect to the central wheel 263 are omitted because these elements are conventional.

Figure 6A:
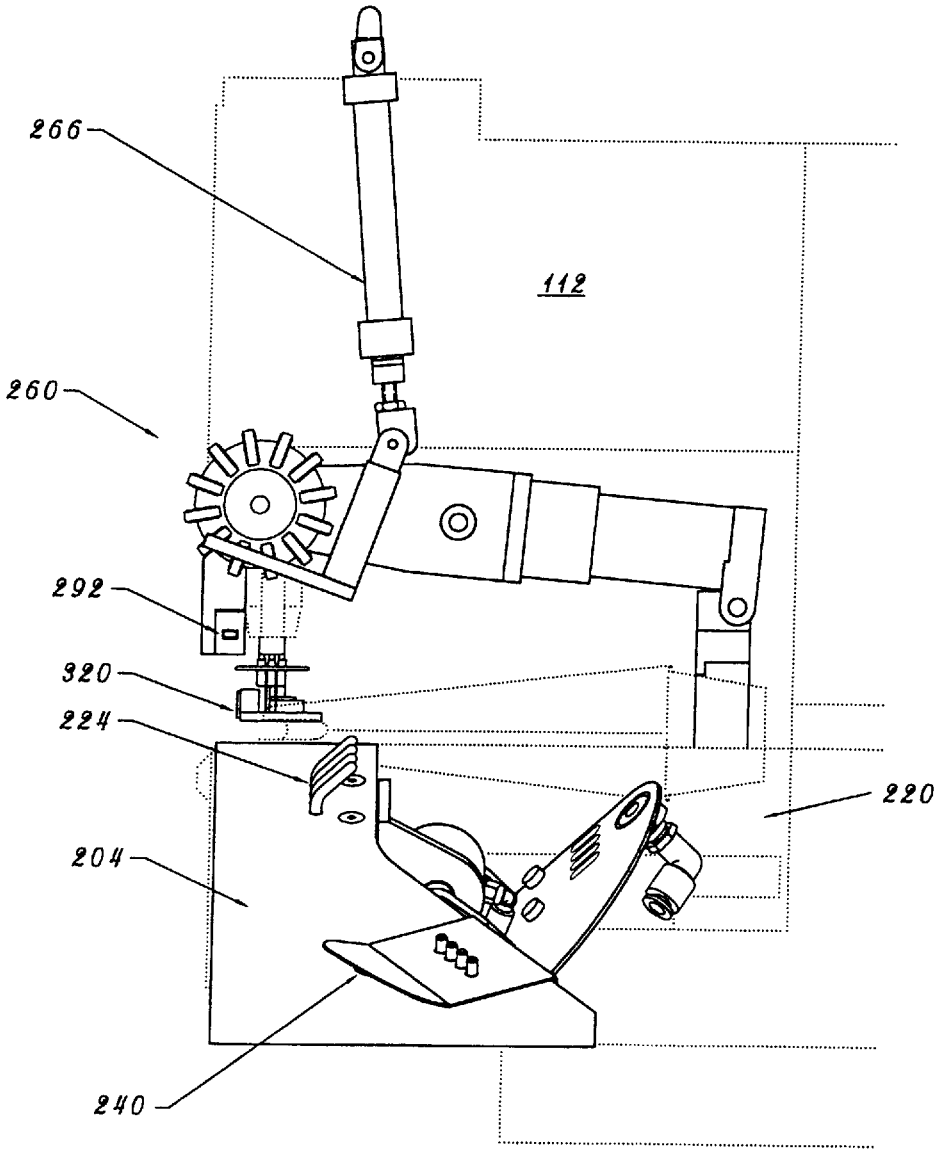
FIG. 6(*a*) is a front view of the invention during the garment loading process in which the fine pneumatic aligners and the wheel aligners are disengaged from the infeed guide plates.
Figure 6B:
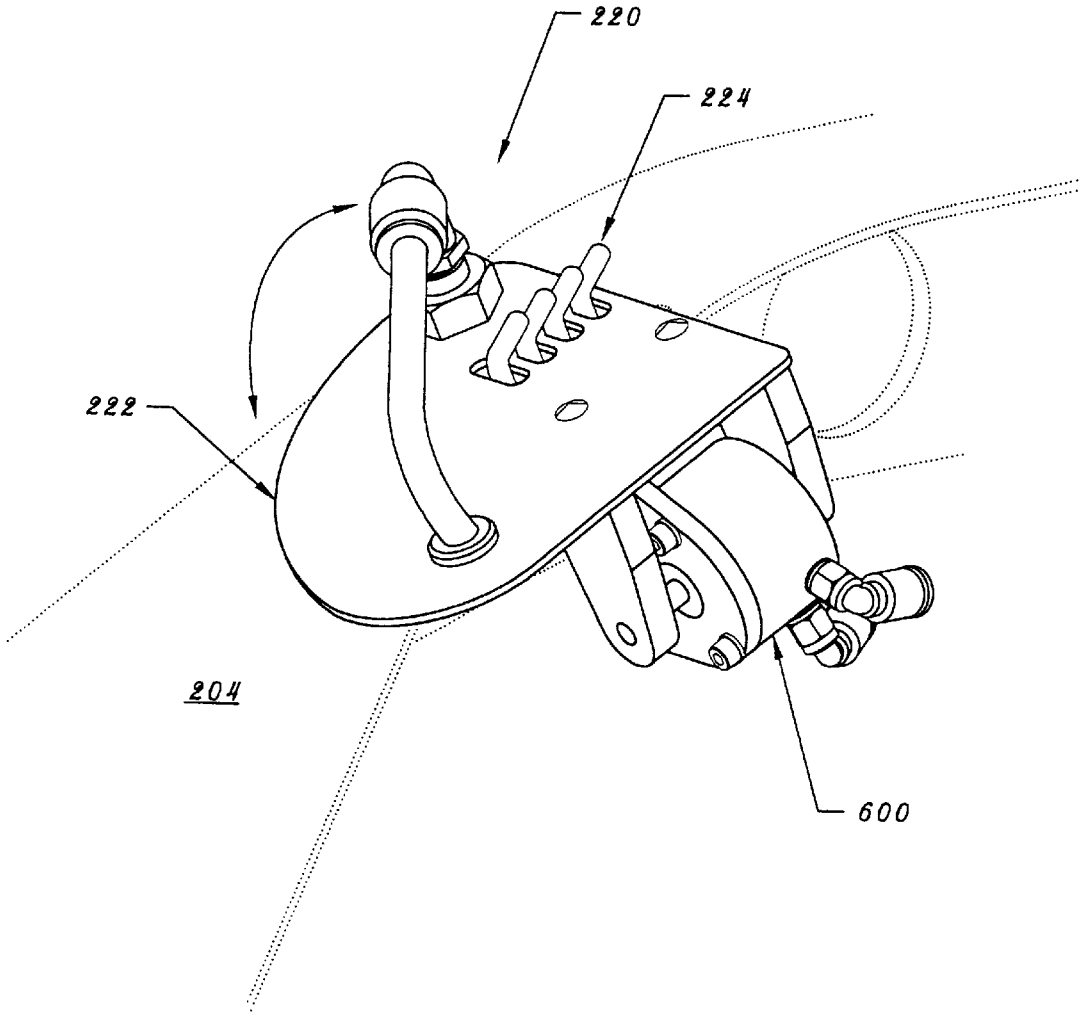
Figure 6C:
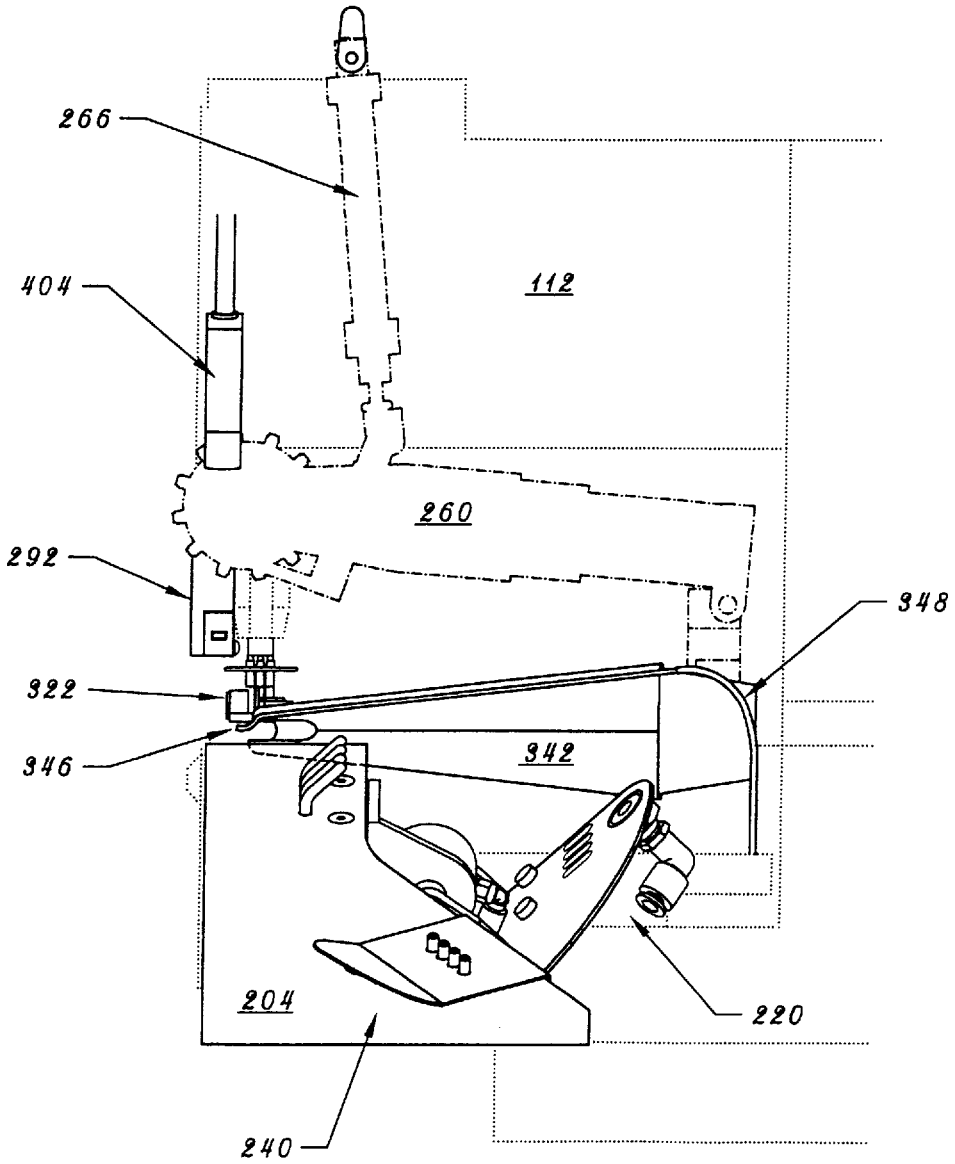

The pivotal motion of the fine pneumatic aligner assembly 220 is shown in FIGS. 3, 6(*a*) and 6(*b*). FIG. 3 shows the partial disengagement of the fine pneumatic aligner 220 away from the right infeed guide plate 204 and FIG. 6(*c*) shows complete disengagement. As can be seen from these figures, the fine alignment pins 224 are connected to infeed guide plate 204 and disengage from the alignment plate 222 when the fine pneumatic alignment assembly 220 disengages from the infeed guide plate 204. This disengagement permits the operator to easily load the garment into the system.

When the sew cycle is triggered, the fine pneumatic alignment assembly 220 swings into the fully engaged position shown in FIG. 2 to engage the garment during the sewing cycle. FIG. 6(*b*) details the fine pneumatic alignment assembly 220 including the disengagement motor 600 and pivotal connection that permits the sewing action between the engaged and disengaged position.

Figure 4:
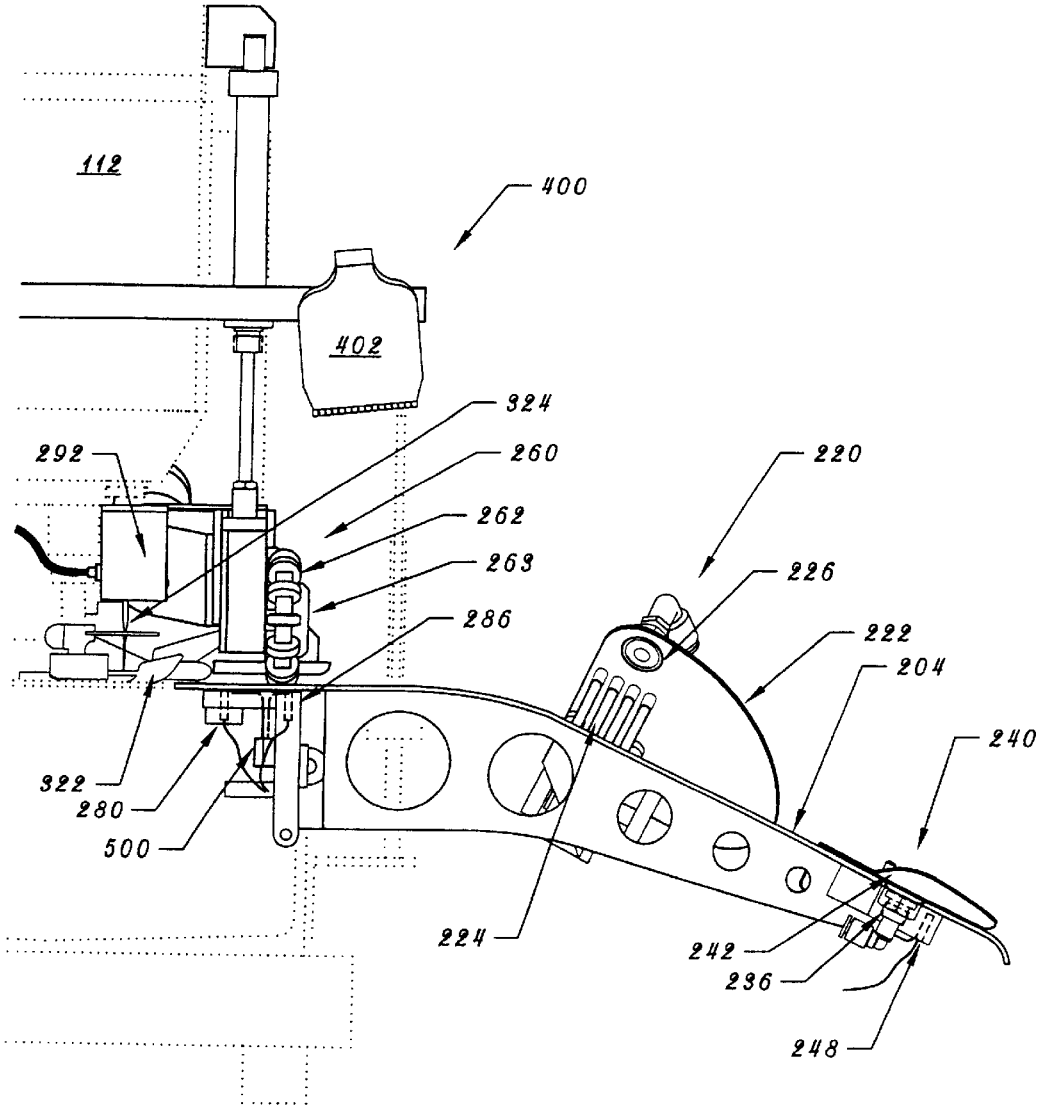
FIG. 4 is a left side view of the right-half of the leg binding system according to the present invention.

As is apparent from the side view in FIG. 4, the infeed guide plates 200, 204 have a shape that curves up and towards the sew heads 110, 112. FIG. 4 also shows further details of the active, mechanical garment aligner 260 including the circumferential arrangement of the secondary wheels 262 around the central wheel 263.

As further shown in FIG. 4, material blower/detector assembly 400 is preferably arranged such that the central blower 402 is above and just downstream with respect to the active, mechanical garment aligner 260. This arrangement permits the airstream from the central blower 402 to force the garment between the left and right infeed guide plates 200, 204 and into the central space 205. Further details of this blowing operation are described in relation to FIG. 7(*c*).

FIG. 4 also more clearly shows the arrangement of the various sensors. More particularly, the arrangement of the material present/foot drop sensor 292 with respect to the sewing needle 324 and the foot 322 can be seen in FIG. 4. FIG. 4 also shows further details of the arrangement between the alignment detector 280, the material edge aberration detector 286 and the start eye 248.

Also shown in FIG. 4 is the structural arrangement of the sew cycle start sensor 248 in relation to the coarse pneumatic aligner assembly 240 and the coarse alignment plate 242.

FIG. 4 also shows further details of the fine pneumatic alignment assembly 220 which includes blower 226, alignment pins 224 and alignment plate 222.

The system also includes a lint blower manifold and jet tubes 500 (See FIG. 5) which are located adjacent to the alignment detectors 270, 280 and the material edge aberration detectors 286 as shown in FIG. 4. The lint blower manifold and jet tubes clean the sensors by blowing air over the sensors to remove lint and/or dust. The lint blower manifold and jet tubes 500 help prevent lint or dust from obscuring the view of the sensors. Thus, the present invention reduces the susceptibility of the invention to being contaminated by lint and dust.

FIG. 5 shows the details of the lint blower manifold and jet tubes 500. In particular, FIG. 5 depicts the aligner sensor lint blower tubes and manifold assembly 500. When the aligner lift cylinder 266 (see FIG. 3) is actuated at the end of the sew cycle, this action also trips a valve which momentarily pulses a blast of air to the lint blower manifold and jet tubes 500 (see FIG. 7(*c*)). These jet tubes are arranged so as to direct the airflow across the top of the sensors 271, 272, 286 (see FIG. 5) and 248 (see FIG. 7(*c*)) after every cycle, to blow off any lint which may have accumulated during the sew cycle. Accumulation of lint will result in mis-reading from the eyes and consequently improper alignment of the garment with respect to the sew head.

FIG. 6(*a*) is a front view of the invention during the garment loading process. To permit the operator to easily access the system, the fine pneumatic aligner assemblies 210, 220 are rotated away from the infeed guide plates 200, 204, respectively. In other words, FIG. 6(*a*) shows the fine pneumatic aligners 210, 220 in their disengaged position. Shown in FIG. 6(*b*), is the pivotal connection of the right fine pneumatic aligner 220 to the right infeed guide plate 204. As further shown in FIG. 6(*b*), a fine aligner disengagement motor 600 provides a driving force for rotating the fine pneumatic aligners between the engaged and disengaged position.

FIG. 6(*a*) also shows the active, mechanical garment aligners 250, 260 in their disengaged position. As can be seen from FIG. 6(*a*), the disengaged positions of the active, mechanical garment aligners 250, 260 and the fine pneumatic aligners 210, 220 permits the operator to easily access the system 100 and slide the garment underneath the sewing assemblies 300, 320 to thereby trigger the material present/foot drop sensors 290, 292.

FIG. 6(*c*) shows the leg binding folder 342 with the attached folder blower 346 and accompanying air supply line 348. As the leading edge of the garment passes under the material present eye 404, the folder blowers 344, 346 turn on. These direct an air stream over the leading edge (corners) of the garment and under the sew head foot 322 to help facilitate the loading process. These blowers 346 shut off once both feet 322 drop as triggered by foot drop eyes 290, 292.

FIGS. 7(*a*) and (*b*) show the arrangement of the garment with respect to the system during the garment loading process. As will be described in more detail below, the central material blower 402 blows air downwards towards the central space 205 between the left and right infeed guide plates 200, 204. This airstream from central material blower 402 forces the garment into the central space 205 as shown in FIG. 7(*a*). FIG. 7(*b*) shows the arrangement of the garment during the sewing cycle.

By forcing the garment into the central space 205, the garment is thereby flattened and smoothed to eliminate any folds in the garment. Also, this airstream from central material blower 402 also provides garment tension against which the left and right active, mechanical garment aligners 250, 260 pull to thereby further align and flattened the garment during the sewing cycle.

FIG. 7(*c*) shows the relationship of the right sew start eye 248 relative to the lint blower 242 for the start eye and the coarse aligner blower 236. As can be seen from FIG. 7(*c*), the lint blower 242 is in a position that permits an air stream therefrom to clean the right sew start eye 248. FIG. 7(*c*) further shows the air stream from the coarse aligner blower 236 towards the coarse aligner pins 234 and coarse aligner plate 232.

Figure 8:
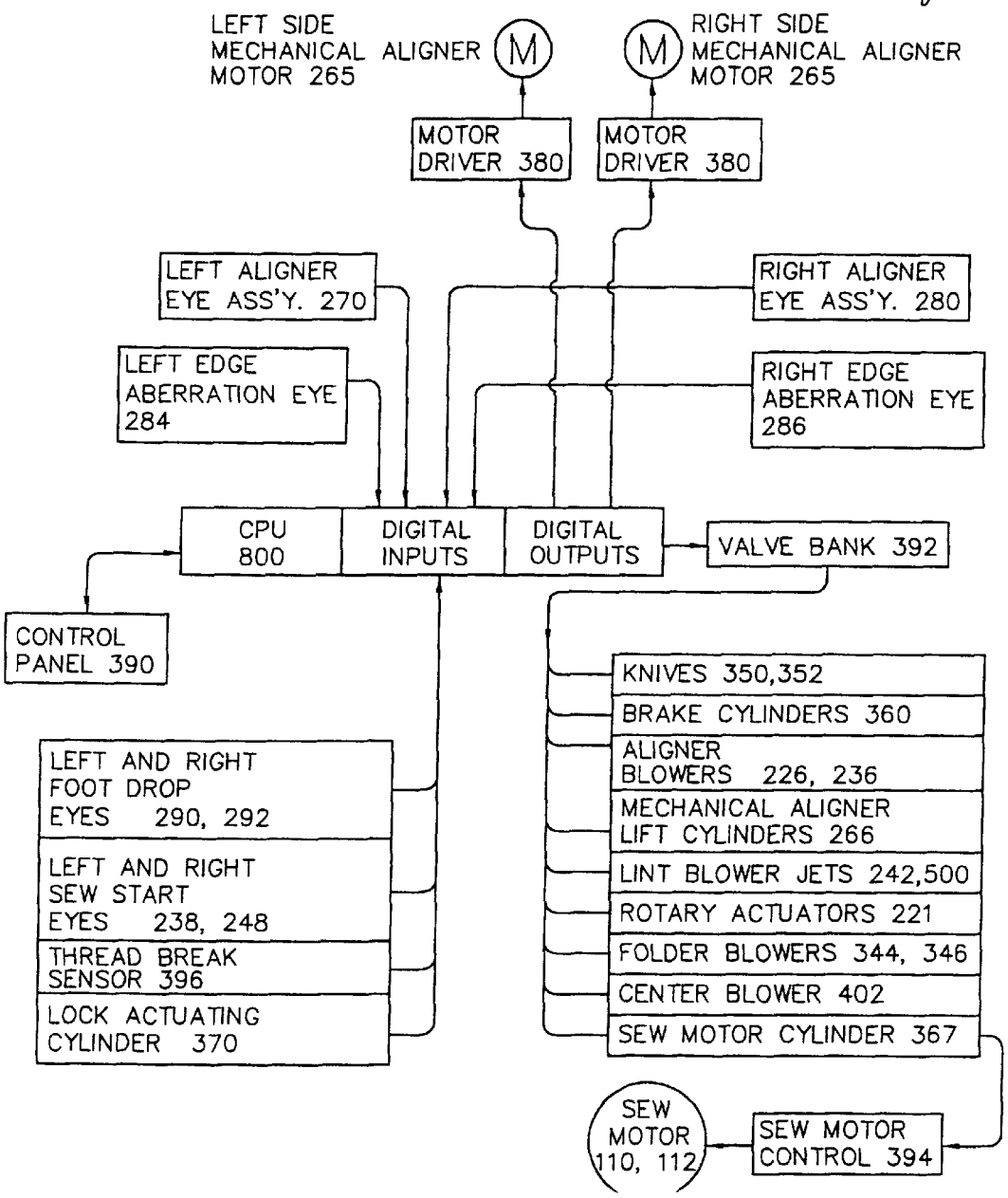
FIG. 8 is a rough schematic diagram showing the electrical arrangement of the various sensors and control apparatus according to the invention.

FIG. 8 is a block diagram showing the electrical arrangement of the various sensors (238, 248, 270, 271, 272, 280, 284, 286, 288, 290, 292 and 404) with respect to a control device 800. As diagrammatically shown in FIG. 8, the electrical arrangement includes a central processing unit (CPU) 800 which receives various digital inputs and digital outputs. The digital inputs include signals from the left and right foot drop eyes 290, 292; left and right sew start eyes 238, 248; a lock actuating cylinder 370; a left edge aberration eye 284; a left aligner eye assembly 270; a right aligner eye assembly 280; and a right edge aberration eye 286. The digital inputs may also include an optional thread break sensor 396 as known in the art.

The CPU 800 processes these various digital inputs as further described below and generates digital outputs. The digital outputs include a valve bank to which is attached leg binding cut off devices 350, 352; brake cylinders 360; aligner blowers 226, 236; mechanical aligner lift cylinders 266; lint blower jets 242, 500; rotary actuators 221; folder blowers 344, 346; center blower 402; and sew motor cylinder 367.

The sew motor cylinder 367 is further connected to a sew motor control 394 and sew motors 110, 112.

The digital outputs further include a pair of motor drivers 380 which drive the left and right side mechanical aligner motors 265. Furthermore, a control panel 390 is connected to the CPU 800 to give the operator various controls over the system 100 for operation, diagnostics, trouble-shooting and fine tuning of the system 100.

Figure 10:
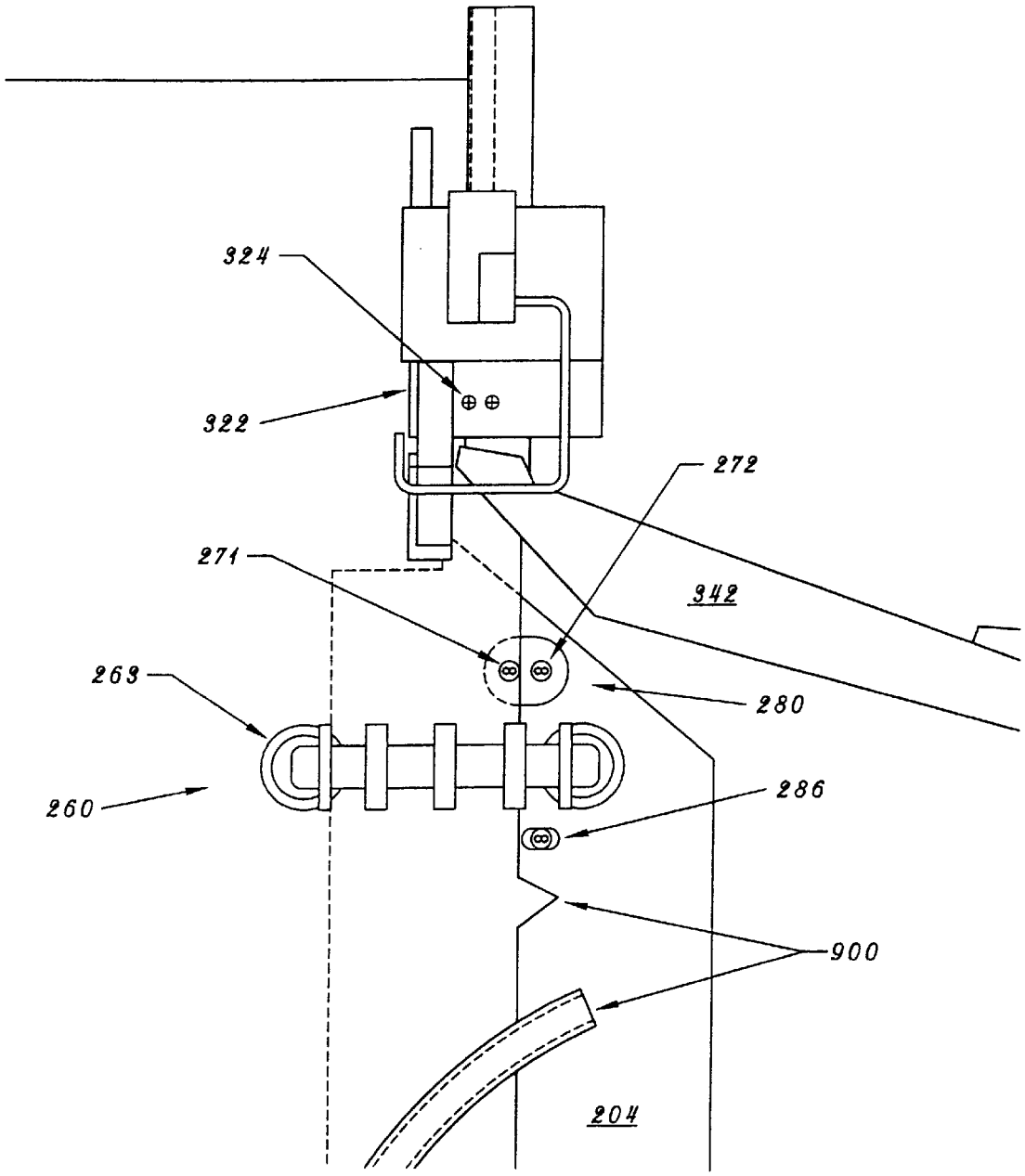
FIG. 10 is a drawing showing a typical material edge aberration in relation to the material edge aberration detector according to the present invention.

FIG. 10 further illustrates the arrangement of the various sensors relative to the active mechanical garment aligner 260. As shown in FIG. 10, the sensors include an inner aligner eye 271 and outer aligner eye 272 which are arranged just upstream with respect to the active mechanical garment aligner 260. The right edge aberration detection eye 286 is arranged just down stream from the active mechanical garment aligner 260 in a position to detect a material edge aberration 900 in time to suppress/actuate the active mechanical garment aligner 260 to thereby correctly align the garment in the lateral direction. The inner and outer aligner eyes 271, 272 form a right aligner eye assembly 280.

OPERATION OF INVENTION

The operation of the invention will be described below. After generally describing the various operations of the system, a particular example including a high-level flow chart in FIG. 9 will be described.

Garment Loading Process

The garment loading process is manually performed by an operator. The relation of the garment to the invention is shown in FIGS. 7(*a*) and 7(*b*). During the garment loading process, the operator grabs the garment by a leading edge and generally lays the garment out longitudinally over the infeed guide plates 200, 204. As shown in FIG. 7(*a*), the fine pneumatic aligners 210, 220 and the active, mechanical garment aligners 250, 260 are disengaged during garment loading. Thus, the operator has easy access to the infeed guide plates 200, 204 and the sew heads 110, 112 so that the garment can be placed directly underneath the sewing feet 322. This action will also trigger the material present/foot drop sensors 290, 292.

When the material present/foot drop sensors 290, 292 detect the presence of the garment, the sewing feet 322 are dropped to engage the leading edge of the garment. The sewing feet may be dropped individually in response to a signal from a corresponding material present/foot drop sensor 290 or 292 or collectively in response to a signal from both sensors 290 and 292.

Immediately thereafter, a signal is sent from the control device 800 to the sew heads 110, 112 to sew a few stitches connecting the left and right leg bindings to the leading edge of the garment. For example, five stitches may be used to capture and hold the garment during the remainder of the garment loading process.

Then, the operator gentle pulls the garment to eliminate large wrinkles or folds and lays the garment longitudinally along the infeed guide plates 200, 204 as shown in FIG. 7(*a*).

Presence of the garment underneath the material detector 404 triggers the folder blowers 344, 346 to come on and assist the garment loading under the feet. Then, the operator smoothes out the material longitudinally along the infeed guide plates 200,204.

Then, triggering either one of the two start eyes 238,248 causes the active mechanical garment aligners 250,260 to drop and begin aligning; the fine aligner assemblies 210,220 to close and begin aligning; the coarse aligners 239,240 to turn on and begin aligning; the central material blower 402 to blow air towards the central space 205 between the guide plates 200, 204. As mentioned above, this airstream forces the garment into the central space 205 to thereby eliminate wrinkles and folds in the garment before the leg bindings are sewn thereon.

Subsequently, the operator slides the garment underneath the coarse pneumatic aligners 230, 240. Presence of the garment within the coarse pneumatic aligners 230, 240 individually triggers the sew cycle start sensors 238, 248. When both sew cycle start sensors 238, 248 are triggered, the sew cycle is initiated.

Sew Cycle Operation

When the sew cycle is initiated, the fine pneumatic aligners 210, 220 are swung into their engaged positions. More particularly, the engagement motors (Rotary Actuators) 600 are energized to bring the fine pneumatic aligners 210, 220 into the engaged position as shown in FIG. 7(*b*).

Furthermore, the active, mechanical garment aligners 250, 260 are engaged with the garment upon the initiation of the sew cycle. More particularly, the aligner lift cylinders 266 are actuated to move the active, mechanical garment aligners 250, 260 into the engaged position via the aligner lift connecting rods 267 and the aligner lift arms 268.

After engaging the active, mechanical garment aligners 250, 260 and the fine pneumatic aligners 210, 220; the sew heads 110, 112 are energized to continue stitching the leg bindings onto the garment. As the leg bindings are stitched onto the garment, the leg bindings are paid-out from the left and right leg binding pay-out assemblies 150, 155 and their tension is controlled with the leg binding tension control structures 156, 158.

Furthermore, the leg bindings are folded with the left and right leg binding folding assemblies 340, 342. The folded leg bindings are then sewn onto the aligned garment with the left and right sewing assemblies 300, 320. Known feed dogs (not shown) provide the driving force for pulling the garment through the sew heads 110, 112.

As the garment is fed into the left and right sewing assemblies 300, 320; the pneumatic garment aligners 210, 220, 230, 240 and the active, mechanical garment aligners 250, 260 cooperate to accurately align the garment as further described below.

The coarse pneumatic aligners 230, 240 blow air from the blowers 236 towards the garment and the infeed guide plates 200, 204. This airstream forces the garment against the aligner pins 234 to thereby coarsely align the garment and eliminate large folds and wrinkles. Thus, coarse alignment for the garment is achieved with the coarse pneumatic aligners 230, 240.

Similarly, the fine pneumatic aligners 210, 220 blow air from respective blowers 226 towards the garment and the infeed guide plates 200, 204. This airstream forces the garment against the pins 224 to thereby finely align the garment and substantially eliminate any remaining folds or wrinkles in the garment. Thus, fine alignment for the garment is achieved with the fine pneumatic aligners 210, 220.

Final alignment is provided by the active, mechanical garment aligners 270, 280 which are actively controlled according to signals from the alignment detectors 270, 280 as follows.

When the garment is disposed between the inner alignment detector 271 and the outer alignment detector 272, the garment is correctly aligned.

When neither the inner or outer alignment detectors 271, 272 are triggered, then the garment is misaligned in an inboard direction. Such an inboard misalignment can be corrected by rotating the central wheel 263 of the mechanical garment aligner 250 in the clockwise direction (looking from the front of the system 100) until correct alignment is achieved.

Similarly, when both the inner and outer alignment detectors 271, 272 are triggered then the garment is misaligned in an outboard direction. Such an outboard misalignment can be corrected by rotating the central wheel 263 of the mechanical garment aligner 250 in the counter-clockwise direction (looking from the front of the system 100) until correct alignment is achieved.

As mentioned above, when only the inner alignment detector 271 is triggered and not the outer alignment detector 272, correct alignment is achieved and rotation of the central wheel 263 by the alignment motor 265 is stopped by the controller 800.

Similar control is provided for the right active, mechanical garment aligner 260 in relation to the right alignment detector 280. The difference is that the rotation of the central wheel 263 of the right mechanical garment aligner 260 is opposite with respect to the left mechanical garment aligner 250.

As mentioned above, the central material blower 402 blows the garment into the central space 205 between the infeed guide plates 200, 204. This airstream not only smoothes and flattens the garment to eliminate folds and wrinkles, but also provides a tension force against which the left and right active, mechanical garment aligners 250, 260 pull. Without this central blowing force, and a space for excess material to go, the active, mechanical garment aligners 250, 260 may introduce unwanted folds into the garment.

Thus, the coarse pneumatic aligners 230, 240; the fine pneumatic aligners 210, 220; and the active, mechanical garment aligners 250, 260 act in concert to accurately align the garment before the leg bindings are sewn thereupon.

The end-of-garment detectors 290 and 292 stop the sewing cycle as follows. During the sewing cycle, the garment will be on top of the end-of-garment detector 290 and 292. When the trailing end of the garment passes over the end-of-garment detector 290 and 292, the sewing cycle is nearly completed. Because the rate of garment feeding is fixed, the length of each stitch is known, and the distance between the end of garment detectors 290 and 292 and the sewing needle 322 is known, the control device 800 can stop the sewing cycle after a predetermined time period or a predetermined number of stitches have been sewn after the signal from the end-of-garment detectors 20 and 292 is received. In other words, when the end of garment detectors 290 and 292 are triggered by the trailing end of the garment, the sewing cycle is stopped at a fixed time interval or a fixed number of stitches sewn thereafter.

As an option, the system may also include left and right material edge aberration detectors 284, 286. Although these material edge aberration detectors 284, 286 are not necessary to the operation of the invention, they are included in the preferred embodiment because they improve the accuracy of garment alignment.

The edge of the garment to which the leg binding is sewn is typically a cut or unfinished edge. Such unfinished edges may include aberrations such as the notch 900 shown in FIG. 10. If this notch 900 passes over the alignment detector 280, it will cause unnecessary movement of the garment by the active, mechanical garment aligner 260.

In other words, the notch 900 will fool the alignment detector 280 into thinking that the material is misaligned. Thus, as described above, the central wheel 263 in the active, mechanical garment aligner 260 will be rotated in a clockwise direction unnecessarily and will cause outboard misalignment of the garment. To account for such material edge aberrations, the present invention preferably includes material edge aberration detectors 284, 286.

The material edge aberration detectors 284, 286 distinguish between minor and localized edge aberrations and actual garment misalignment. The basic distinction is that material edge aberrations are usually localized in nature. Thus, the material edge aberration detectors 284, 286 will see this edge aberration only for a short amount of time.

Therefore, a time threshold based on the length of that the material edge aberration detectors 284, 286 do not see the garment may be used to distinguish between actual aberrations and garment misalignment. The threshold length of the material edge aberration is approximately ½ cm to 3 cm and most preferably about 1 cm. If the time period is greater than a predetermined time period corresponding to the threshold length, then garment misalignment has occurred and the control device 800 permits the active, mechanical garment aligner to align the garment based on the alignment sensors 270, 280.

If, on the other hand, this time interval is shorter than the predetermined time interval, then the control device 800 will suppress the operation of the active, mechanical garment aligner 260. Suppressing the operation of the active, mechanical garment aligner 260 will begin at a fixed time after the trailing end of the edge aberration passes over the material edge aberration detector 286 and will last for the time period that the material edge aberration detector 286 saw this edge aberration.

A similar operation is individually performed by the left material edge aberration detector 284 acting in cooperation with the control device 800 and the active, mechanical garment aligner 250.

Figure 9A:
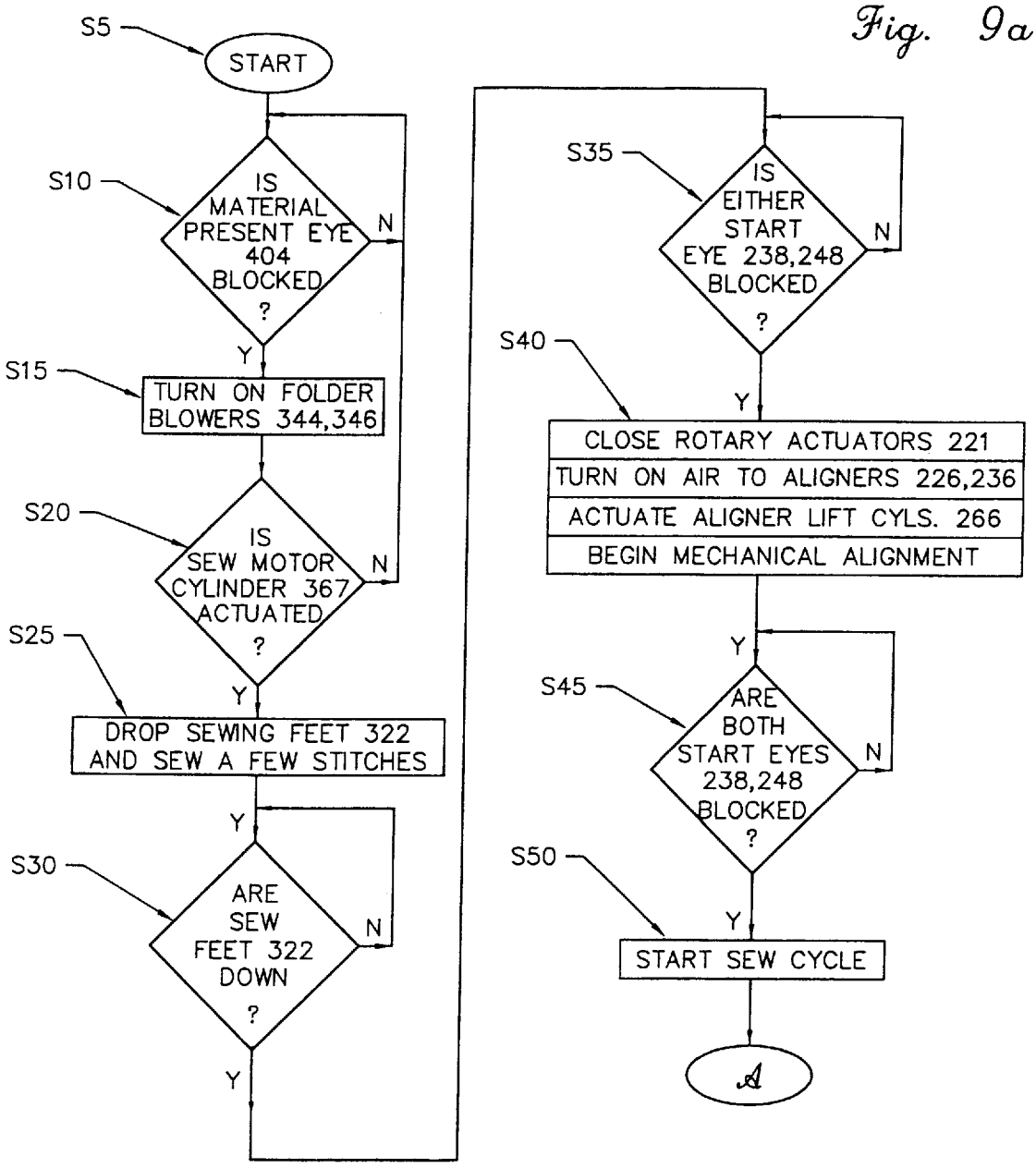
FIGS. 9(*a*) and 9(*b*) are high-level flow charts showing an example of the operational control of the invention.
Figure 9B:
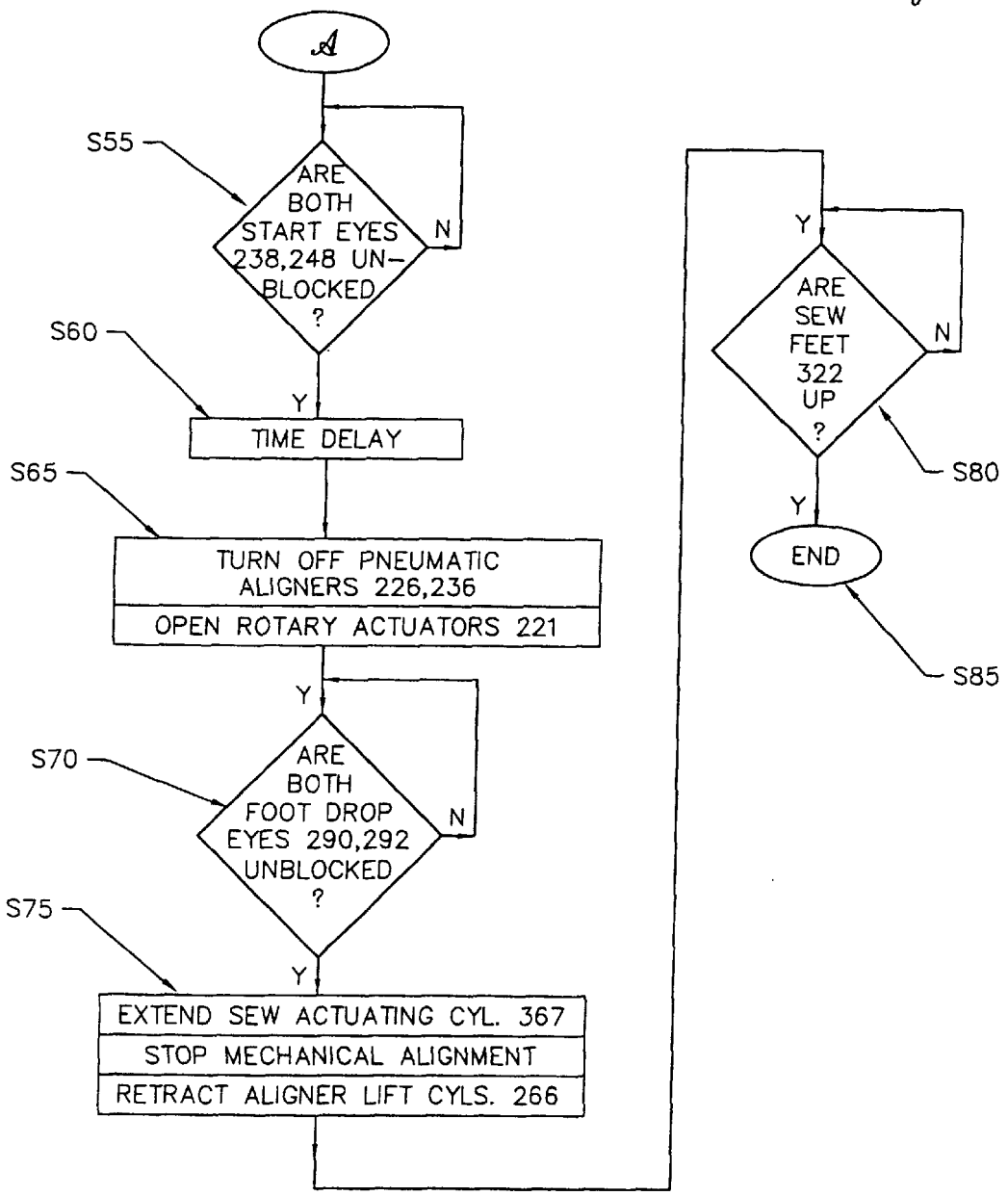

FIGS. 9(*a*) and (*b*) illustrate a particular example including high-level flow charts for controlling the operation of the system 100. The exemplary control process begins in FIG. 9(*a*) with start step S5 and then proceeds to decision step S10 which checks the material present sensor eye 404 to see if it is blocked indicating that material is present. If not, the process moves back to step S10 to continue checking sensor 404 until material is present. When this condition occurs and material is present under sensor 404, the process proceeds to step S10 which turns on the folder blowers 344, 346.

Then, step S20 is performed which decides whether the sew motor cylinder 367 is actuated. If not, the process loops back to step S10, otherwise the process proceeds with step S25 which drops the sewing feed to 322 and sews a few stitches.

Next, decision step S30 checks whether the sew feet 322 are down. If not, the process continues to check whether the sew feet are down until this condition occurs. When the sew feet are down, decision step S35 is then executed which checks whether either start eye 238 or 248 is blocked indicating material present under the start eye 238, 248. Step S35 is repeatedly performed until material is present under either start eye 238 or 248. Thereafter, step S40 closes rotary actuators 221; turns on the air supply to aligners 226, 236; actuates aligner lift cylinders 266; and begins the mechanical alignment process.

Next, decision step S45 checks whether both start eyes 238, 248 are blocked indicating material under both start eyes 238, 248. When step S45 finds that this condition has been met, then step S50 is performed which starts the sew cycle. The process proceeds, as indicated by connector A with FIG. 9(*b*).

After starting the sew cycle in step S50, step S55 in FIG. 9(*b*) checks whether both start eyes 238, 248 are unblocked. When both start eyes 238, 248 are unblocked, then the sew cycle is nearly completed with only the trailing end of the garment requiring stitching. Then, a time delay is awaited in step S60 before step S65 turns off the pneumatic aligners 226, 236 and opens the rotary actuators 221 to disengage the fine pneumatic aligners 226, 236 away from the infeed guide plates 200, 204.

Then, step S70 checks whether both foot drop eyes 290, 292 are unblocked. When this condition occurs, then step S75 extends the sew actuating cylinder 367; stops mechanical alignment by the active, mechanical garment aligners 250, 260; and retracts the aligner lift cylinders 266 to disengage the mechanical garment aligners 250, 260 away from the infeed guide plates 200, 204.

Then, step S80 checks whether the sew feed 322 are up. If yes, then the process ends as indicated by step S85.

It is to be understood that the process illustrated in FIGS. 9(*a*)–(*b*) may be embodied in either hardware, software or a combination of hardware and software as known to those of ordinary skill in the art. The exemplanary embodiment shown in the drawings, particularly FIG. 8, illustrates a CPU 800. In this exemplanary embodiment, the process of FIG. 9 can be utilized to program CPU 800 and thereby arrive as a specially programmed machine.

The invention is subject to other various modifications. For example, another pair or perhaps several pairs of pneumatic aligners may be provided in addition to the coarse pneumatic aligners 230, 240 and fine pneumatic aligners 210, 220. These additional pneumatic aligners could be placed between the fine pneumatic aligners 210, 220 and the active, mechanical garment aligners 250, 260. Preferably, these extra pneumatic aligners would disengage from the left and right infeed guide plates 200, 204 during the garment loading process in a manner similar to the fine pneumatic aligners 210, 220.

FIG. 12 shows an optional, inventive leg binding payout spool assembly 355 which may be utilized in place of the conventional leg binding payout spool assembly 155 shown in FIG. 1. The conventional spool assembly 155 merely includes a plate 154 and a shaft 152, which led to binding tension problems associated with drag and weight. The new alternative design shown in FIG. 12 allows the binding material 362 to spin freely as the spool support 357 rides in two bearings 354 axially arranged around the spool shaft 353. While this eliminates any excess tension due to drag, a brake must be used to stop any over-spin of the material. This is comprised of a height adjustment bracket 356 which also houses the brake pad 358 and the brake pad actuating cylinder 360. In use, as the machine is sewing, the brake pad 358 retracts allowing the spool 154 and binding 362 to spin freely. As the machine completes the sew cycle, the brake 358 is pneumatically applied thus eliminating any backlash from the binding material 362.

Figure 13:
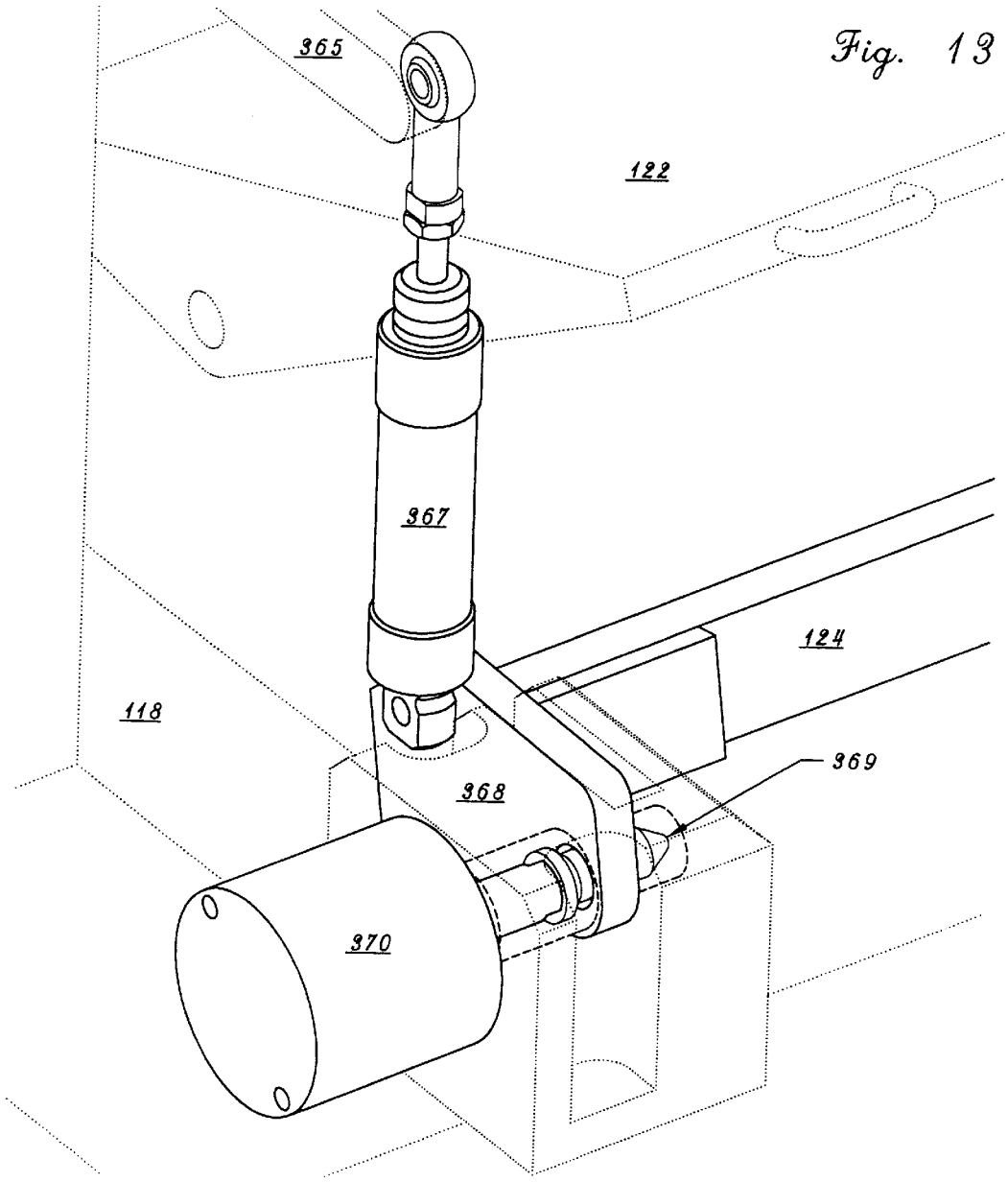
FIG. 13 is a detailed drawing of an automatic mode locking assembly according to the present invention.

In order to differentiate between manual sewing mode and automatic sewing mode, an automatic mode locking assembly 364 may also be used as shown in FIG. 13. This assembly 364 takes the place of an operator needing to apply foot pressure to operate the central sewing pedal 124. In use, the central sewing pedal 124 is depressed to allow the locking pin actuating cylinder 370 to lock the pedal 124 in place by inserting a locking pin 369 through the foot pedal locking bracket 368. At this point, the sew motor actuating cylinder 367 is retracted which pulls down the sew motor actuating lever 365 thus allowing the machine to sew. During manual operation, the locking pin 369 is withdrawn and the sew motor actuating cylinder 367 retracted allowing normal foot pedal 124 control.

Figure 14:
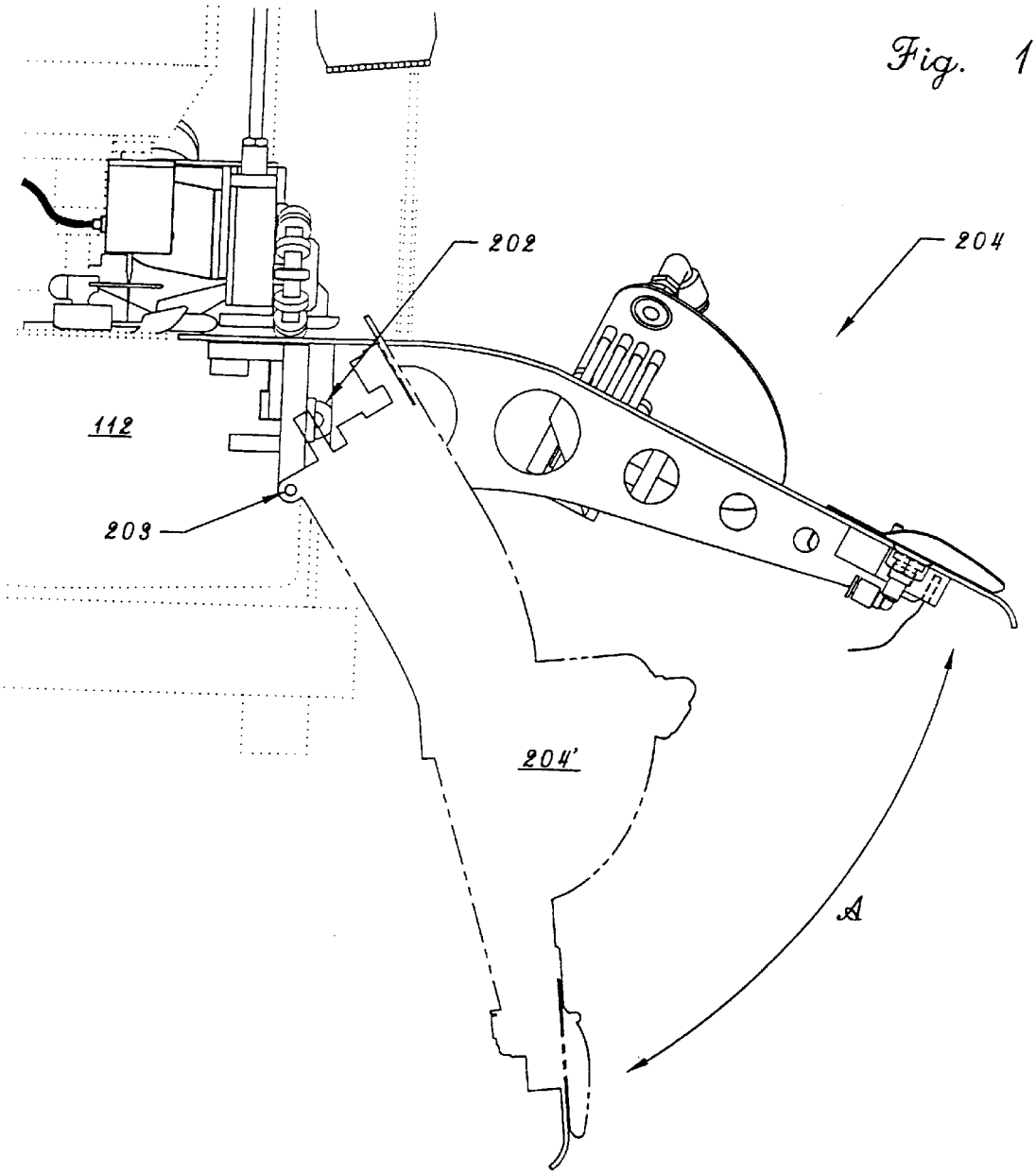
FIG. 14 illustrates the pivotal connection between the infeed guide plates and the sew heads to facilitate normal maintenance of the sew heads.

FIG. 14 shows another optional configuration providing a pivotal connection between the infeed guide plates 200, 204 and the sew heads 110, 112. In order to facilitate normal maintenance to either sew head 110, 112, the infeed guide plates 200, 204 are designed to swing down and out of the way, exposing the internal components (looper, feed dogs, differential, etc.) of the sew head 110, 112 and to allow threading of the looper. The infeed guide plates 200, 204 are held in place with a slide latch 202, which when disengaged, allows the guide plates 200, 204 to pivot about the pivot pins 203 along a path depicted by arrow "A". Reference numeral 204' shows the pivot position of the right infeed guide plate 204 with respect to the right sew head 112.

Figure 15:
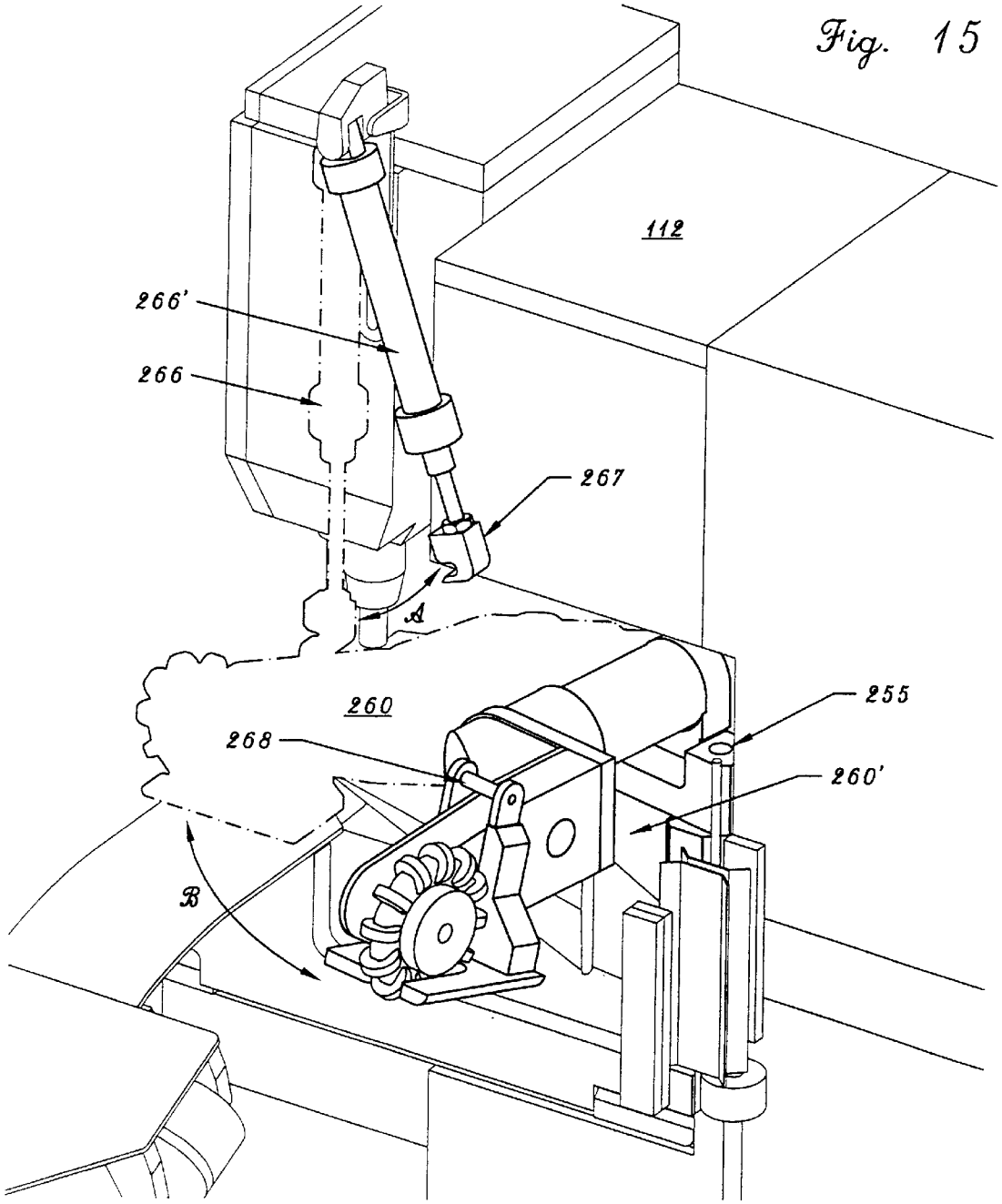
FIG. 15 illustrates the disengagement feature of the mechanical garment aligners away from the infeed guide plates.

FIG. 15 shows the disengagement feature of the mechanical aligners 250, 260 to provide access to the foot area of the sew head 112 for maintenance and threading purposes. The aligner lift cylinder 266 is retracted, the connecting rod 267 is disconnected from the aligner lift arm 268 and the whole assembly is swung out of the way as shown by path "A" into position 266'. The whole mechanical aligner assembly 260 may then be rotated about the aligner pivot pin 255 following path "B" and into position 260'. It should be noted that the connecting rod 267 is held to the lift arm 268, and that the aligner assembly 260, are held in their home position by means of a ball detent catch as known to the art. The whole mechanical aligner assembly 260 may then be rotated about pivot pin 255

With the invention described above, high quality garments can be rapidly produced. The semi-automatic leg binding system not only accurately aligns the garment, but also allows the operator to pick up the next garment for loading while the sewing cycle is automatically performed. Thus, as soon as the sew cycle is completed, the operator can be ready to load the next garment. This greatly increases operator efficiency. Furthermore, the automatic sewing cycle is performed much faster than any manually performed leg biding operation.

It is to be further understood that the term "needle" is a broad term which may include a plurality of needles as known in the art. For example, the current practice for sewing leg bindings onto men's briefs includes two needles which sew a two-needle, bottom cover stitch to attach the leg binding to the garment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A leg binding attachment system for simultaneously attaching both leg bindings on a garment, comprising:

a pair of sew heads for simultaneously sewing left and right leg bindings on the garment;

a pair of infeed guide plates mounted to said sew heads and terminating at said pair of sew heads;

a plurality of pneumatic garment aligners mounted on said infeed guide plates, said pneumatic garment aligners blowing the garment against alignment pins mounted on said infeed guide plates;

alignment detectors mounted in said infeed guide plates, said alignment detectors detecting alignment of the garment with respect to each of said infeed guide plates; and a pair of active, mechanical garment aligners actively aligning the garment during a sewing cycle according to an output of said alignment detectors, wherein an operator manually loads the garment onto said infeed guide plates, engages the garment with the plurality of pneumatic garment aligners and initiates a sewing cycle whereupon said pair of sew heads simultaneously sew both leg bindings on the garment while said pneumatic garment aligners, said central material blower and said active, mechanical garment aligners maintain garment alignment.

2. The leg binding attachment system according to claim 1, further comprising:

a central space provided between said infeed guide plates; and a central material blower mounted above said pair of infeed guide plates and facing towards said central space, said central material blower being triggered by initiation of the sewing cycle.

3. The leg binding attachment system according to claim 1, said plurality of pneumatic garment aligners including a pair of coarse pneumatic garment aligners and a pair of fine pneumatic garment aligners, said coarse pneumatic garment aligners mounted upstream on said infeed guide plates with respect to said fine pneumatic garment aligners.

4. The leg binding attachment system according to claim 3, each of said pneumatic garment aligners including an alignment plate disposed above and substantially parallel to said infeed guide plates, a blower for blowing air towards a respective infeed guide plate, said pneumatic garment aligners engaging the alignment pins which permit air from the blower to pass therethrough and which provide a surface against which the garment is blown by the blower.

5. The leg binding attachment system according to claim 3, further comprising:

a sewing cycle trigger triggering initiation of the sewing cycle, said pneumatic garment alignors being activated when said sewing cycle is triggered by said sewing cycle trigger.

6. The leg binding attachment system according to claim 5, said sewing cycle trigger including a pair of sewing cycle start sensors mounted to said coarse pneumatic aligners, wherein both sewing cycle start sensors must be triggered to initiate the sewing cycle.

7. The leg binding attachment system according to claim 6, each of said sewing cycle start sensors including a photoelectric eye for detecting the presence of the garment in the corresponding coarse pneumatic aligner, wherein both photoelectric eyes must be triggered before the sewing cycle is initiated.

8. The leg binding attachment system according to claim 3, further comprising a pair of disengaging devices disengaging said pair of fine pneumatic garment aligners from said pair of infeed guide plates during garment loading and engaging said fine pneumatic garment aligners with the garment during the sewing cycle.

9. The leg binding attachment system according to claim 8, each of said disengaging devices including:

a hinge for pivotally attaching said fine pneumatic garment aligner to said infeed guide plate, and a motor mounted between said fine pneumatic garment aligner and said infeed guide plate, said motor driving the fine pneumatic garment aligner towards and away from said infeed guide to engage and disengage the fine pneumatic garment aligner.

10. The leg binding attachment system according to claim 1, each of said active, mechanical garment aligners including:

a ring of wheels having a rotatable ring circumferentially supporting a plurality of rotatable wheels wherein the rotatable wheels rotate in a garment feeding direction during the sewing cycle; and a rotator forcibly rotating the ring of wheels in a garment alignment direction during the sewing cycle.

11. The leg binding attachment system according to claim 1, further comprising an active, mechanical garment aligner disengagement device disengaging said active, mechanical garment aligners from said infeed guide plates during garment loading and engaging said active, mechanical garment aligners with the garment during the sewing cycle.

12. The leg binding attachment system according to claim 11, said active, mechanical garment aligner disengagement device having a pair of aligner lift assemblies each of which includes:

an aligner lift arm pivotally mounted to one of said sew heads at a first end and rotatably supporting said active, mechanical garment aligner at a second end;

a pneumatic cylinder mounted to one of said sew heads; and an aligner lift connecting rod connecting the pneumatic cylinder with the aligner lift arm, wherein said pneumatic cylinder raises and lowers the aligner lift arm via the aligner lift connecting rod to disengage and engage said active, mechanical garment aligner.

13. The leg binding attachment system according to claim 12, each of said active, mechanical garment aligners including:

a ring of wheels having a rotatable ring circumferentially supporting a plurality of rotatable wheels wherein the rotatable wheels rotate in a garment feeding direction during the sewing cycle;

a rotator forcibly rotating the ring of wheels in a garment alignment direction during the sewing cycle;

said aligner lift arm pivotally mounted to one of said sew heads at a first end and rotatably supporting the ring of wheels at a second end, wherein said pneumatic cylinder raises and lowers the aligner lift arm via the aligner lift connecting rod to disengage and engage said ring of wheels.

14. The leg binding attachment system according to claim 1, further comprising:

material edge aberration detectors mounted in said infeed guide plates in an upstream direction with respect to said active, mechanical garment aligners and substantially aligned with said alignment detectors along a garment feeding path; and a controller individually controlling each of said active, mechanical garment aligners according to an output from a corresponding one of said material edge aberration detectors.

15. The leg binding attachment system according to claim 14, said controller individually inhibiting operation of each of said active, mechanical garment aligners when a material edge aberration is detected by a corresponding one of said material edge aberration detectors.

16. The leg binding attachment system according to claim 15, said controller distinguishing between a material edge aberration and a garment misalignment condition by determining if a time period in which the garment's presence is not detected by said material edge aberration detector exceeds a time limit.

17. The leg binding attachment system according to claim 16, wherein the time limit corresponds to a material edge aberration of about ½ cm to 3 cm.

18. The leg binding attachment system according to claim 14, each of said material edge aberration detectors including a photo-electric eye.

19. The leg binding attachment system according to claim 5, further comprising lint blower manifold and jet tubes for cleaning said alignment detectors and said sewing cycle trigger.

20. The leg binding attachment system according to claim 14, further comprising lint blower manifold and jet tubes for cleaning said material edge aberration detectors.

21. The leg binding attachment system according to claim 1, further comprising:

leg binding folders for folding leg bindings before the leg bindings are supplied to said pair of sew heads;

leg binding folder blowers for blowing air over leading edges of the garment to facilitate the garment landing process; and a material detector detecting presence of the garment and triggering said leg binding folder blowers when the garment is detected.

22. The leg binding attachment system according to claim 1, further comprising:

leg binding payout assemblies for paying out leg bindings to said sew heads, each of said leg binding payout assembling including:

a spool shaft, a spool support, bearings axially arranged around said spool shaft for supporting said spool support, a brake for allowing said spool support to spin freely during the sew cycle and for preventing over-spin of the leg binding upon completion of the sewing cycle.

23. The leg binding attachment system according to claim 22, said brake further including:

a height adjustment mechanism, a brake pad, a pneumatic brake pad actuating cylinder for engaging said brake pad when the sewing cycle is complete and disengaging said brake pad during the sewing cycle.

24. The leg binding attachment system according to claim 1, further comprising:

hinge means for providing a pivotal connection between said infeed guide plates and said sew heads.

25. The leg binding attachment system according to claim 1, further comprising:

an automatic mode locking assembly for permitting the operator to lock the system into an automatic mode wherein the sewing cycle is automatically performed or into a manual mode cycle wherein the operator manually controls the sewing cycle.

26. A garment guiding apparatus for guiding a garment into a dual leg binding attachment apparatus including a pair of sew heads for simultaneously sewing left and right leg bindings on the garment, the garment guiding apparatus comprising:

a pair of infeed guide plates mounted to the sew heads and terminating at the pair of sew heads;

a plurality of pneumatic garment aligners mounted on said infeed guide plates, said pneumatic garment aligners blowing the garment against alignment pins mounted on said infeed guide plates;

alignment detectors mounted in said infeed guide plates, said alignment detectors detecting alignment of the garment with respect to each of said infeed guide plates; and a pair of active, mechanical garment aligners actively aligning the garment during a sewing cycle according to an output of said alignment detectors, wherein an operator manually loads the garment onto said infeed guide plates, engages the garment with the plurality of pneumatic garment aligners and initiates a sewing cycle whereupon said pair of sew heads simultaneously sew both leg bindings on the garment while said pneumatic garment aligners, said central material blower and said active, mechanical garment aligners maintain garment alignment.

27. The leg binding attachment system according to claim 26, further comprising:

a central space provided between said infeed guide plates;

a central material blower mounted above said pair of infeed guide plates and facing towards said central space, said central material blower being triggered by initiation of the sewing cycle.

28. The leg binding attachment system according to claim 26, said plurality of pneumatic garment aligners including a pair of coarse pneumatic garment aligners and a pair of fine pneumatic garment aligners, said coarse pneumatic garment aligners mounted upstream on said infeed guide plates with respect to said fine pneumatic garment aligners.

29. The leg binding attachment system according to claim 28, each of said pneumatic garment aligners including an alignment plate disposed above and substantially parallel to said infeed guide plates, a blower for blowing air towards a respective infeed guide plate, said pneumatic garment aligners engaging the alignment pins which permit air from the blower to pass therethrough and which provide a surface against which the garment is blown by the blower.

30. The leg binding attachment system according to claim 28, further comprising a sewing cycle trigger triggering initiation of the sewing cycle, said pneumatic garment aligners being activated when said sewing cycle is triggered by said sewing cycle trigger.

31. The leg binding attachment system according to claim 30, said sewing cycle trigger including a pair of sewing cycle start sensors mounted to said coarse pneumatic aligners, wherein both sewing cycle start sensors must be triggered to initiate the sewing cycle.

32. The leg binding attachment system according to claim 31, each of said sewing cycle start sensors including a photoelectric eye for detecting the presence of the garment in the corresponding coarse pneumatic aligner, wherein both photoelectric eyes must be triggered before the sewing cycle is initiated.

33. The leg binding attachment system according to claim 28, further comprising a pair of disengaging devices disengaging said pair of fine pneumatic garment aligners from said pair of infeed guide plates during garment loading and engaging said fine pneumatic garment aligners with the garment during the sewing cycle.

34. The leg binding attachment system according to claim 33, each of said disengaging devices including:

a hinge for pivotally attaching said fine pneumatic garment aligner to said infeed guide plate, and an actuator mounted between said fine pneumatic garment aligner and said infeed guide plate, said actuator driving the fine pneumatic garment aligner towards and away from said infeed guide to engage and disengage the fine pneumatic garment aligner.

35. The leg binding attachment system according to claim 26, each of said active, mechanical garment aligners including:

a ring of wheels having a rotatable ring circumferentially supporting a plurality of rotatable wheels wherein the rotatable wheels rotate in a garment feeding direction during the sewing cycle; and a rotator forcibly rotating the ring of wheels in a garment alignment direction during the sewing cycle.

36. The leg binding attachment system according to claim 26, further comprising an active, mechanical garment aligner disengagement device disengaging said active, mechanical garment aligners from said infeed guide plates during garment loading and engaging said active, mechanical garment aligners with the garment during the sewing cycle.

37. The leg binding attachment system according to claim 36, said active, mechanical garment aligner disengagement device having a pair of aligner lift assemblies each of which includes:

an aligner lift arm pivotally mounted to one of said sew heads at a first end and rotatably supporting said active, mechanical garment aligner at a second end;

a pneumatic cylinder mounted to one of said sew heads; and an aligner lift connecting rod connecting the pneumatic cylinder with the aligner lift arm, wherein said pneumatic cylinder raises and lowers the aligner lift arm via the aligner lift connecting rod to disengage and engage said active, mechanical garment aligner.

38. The leg binding attachment system according to claim 37, each of said active, mechanical garment aligners including:

a ring of wheels having a rotatable ring circumferentially supporting a plurality of rotatable wheels wherein the rotatable wheels rotate in a garment feeding direction during the sewing cycle;

a rotator forcibly rotating the ring of wheels in a garment alignment direction during the sewing cycle;

said aligner lift arm pivotally mounted to one of said sew heads at a first end and rotatably supporting the ring of wheels at a second end, wherein said pneumatic cylinder raises and lowers the aligner lift arm via the aligner lift connecting rod to disengage and engage said ring of wheels.

39. The leg binding attachment system according to claim 26, further comprising:

material edge aberration detectors mounted in said infeed guide plates in an upstream direction with respect to said active, mechanical garment aligners and substantially aligned with said alignment detectors along a garment feeding path; and a controller individually controlling each of said active, mechanical garment aligners according to an output from a corresponding one of said material edge aberration detectors.

40. The leg binding attachment system according to claim 39, said controller individually inhibiting operation of each of said active, mechanical garment aligners when a material edge aberration is detected by a corresponding one of said material edge aberration detectors.

41. The leg binding attachment system according to claim 40, said controller distinguishing between a material edge aberration and a garment misalignment condition by determining if a time period in which the garment's presence is not detected by said material edge aberration detector exceeds a time limit.

42. The leg binding attachment system according to claim 41, wherein the time limit corresponds to a material edge aberration of about ½ cm to 3 cm.

43. The leg binding attachment system according to claim 39, each of said material edge aberration detectors including a photo-electric eye.

44. The leg binding attachment system according to claim 26, further comprising lint blower manifold and jet tubes for cleaning said alignment detectors and said sewing cycle trigger.

45. The leg binding attachment system according to claim 39, further comprising lint blower manifold and jet tubes for cleaning said material edge aberration detectors.

46. The leg binding attachment system according to claim 26, further comprising:

leg binding folders for folding leg bindings before the leg bindings are supplied to said pair of sew heads;

leg binding folder blowers for blowing air over leading edges of the garment to facilitate the garment landing process; and a material detector detecting presence of the garment when the garment is detected.

47. The leg binding attachment system according to claim 26, further comprising:

leg binding payout assemblies for paying out leg bindings to said sew heads, each of said leg binding payout assembling including:

a spool shaft, a spool support, bearings axially arranged around said spool shaft for supporting said spool support, a brake for allowing said spool support to spin freely during the sew cycle and for preventing over-spin of the leg binding upon completion of the sewing cycle.

48. The leg binding attachment system according to claim 47, said brake further including:

a height adjustment mechanism, a brake pad, a pneumatic brake pad actuating cylinder for engaging said brake pad when the sewing cycle is complete and disengaging said brake pad during the sewing cycle.

49. The leg binding attachment system according to claim 26, further comprising:

hinge means for providing a pivotal connection between said infeed guide plates and said sew heads.

50. The leg binding attachment system according to claim 26, further comprising:

an automatic mode locking assembly for permitting the operator to lock the system into an automatic mode wherein the sewing cycle is automatically performed or into a manual mode cycle wherein the operator manually controls the sewing cycle.

* * * * *